US009149087B2

(12) United States Patent
Abshire

(10) Patent No.: US 9,149,087 B2
(45) Date of Patent: Oct. 6, 2015

(54) SHOE SOLES FOR SHOCK ABSORPTION AND ENERGY RETURN

(75) Inventor: Danny Abshire, Boulder, CO (US)

(73) Assignee: NEWTON RUNNING COMPANY, INC., Boulder, CO (US)

( * ) Notice: Subject to any disclaimer, the term of this patent is extended or adjusted under 35 U.S.C. 154(b) by 900 days.

(21) Appl. No.: 13/204,580

(22) Filed: Aug. 5, 2011

(65) Prior Publication Data

US 2013/0031804 A1 Feb. 7, 2013

(51) Int. Cl.

| | |
|---|---|
| ***A43B 13/18*** | (2006.01) |
| ***A43B 7/14*** | (2006.01) |
| ***A43B 13/12*** | (2006.01) |
| ***A43B 13/14*** | (2006.01) |

(52) U.S. Cl.

CPC ..... *A43B 13/187* (2013.01); *A43B 7/144* (2013.01); *A43B 7/145* (2013.01); *A43B 7/149* (2013.01); *A43B 7/1425* (2013.01); *A43B 7/1435* (2013.01); *A43B 7/1445* (2013.01); *A43B 7/1465* (2013.01); *A43B 13/122* (2013.01); *A43B 13/145* (2013.01); *A43B 13/183* (2013.01); *A43B 13/185* (2013.01); *A43B 13/188* (2013.01); *A43B 13/189* (2013.01)

(58) Field of Classification Search

CPC .... A43B 13/12; A43B 13/122; A43B 13/141; A43B 13/16; A43B 13/184; A43B 13/185

See application file for complete search history.

(56) References Cited

U.S. PATENT DOCUMENTS

| | | | | |
|---|---|---|---|---|
| 4,485,568 A * | 12/1984 | Landi et al. | ..... | 36/44 |
| 5,647,145 A * | 7/1997 | Russell et al. | ..... | 36/28 |
| 5,937,544 A | 8/1999 | Russell | | |
| 6,023,859 A * | 2/2000 | Burke et al. | ..... | 36/105 |
| 6,195,915 B1 | 3/2001 | Russell | | |
| 6,327,795 B1 | 12/2001 | Russell | | |
| 6,330,757 B1 | 12/2001 | Russell | | |
| 6,412,196 B1 * | 7/2002 | Gross | ..... | 36/102 |

(Continued)

FOREIGN PATENT DOCUMENTS

| | | |
|---|---|---|
| CA | 2340039 | 2/2009 |
| CN | 99812323.4 | 3/2008 |

(Continued)

OTHER PUBLICATIONS

Extended European Search Report, filed May 22, 2015 in European Patent Application No. 12822117.3 filed Jan. 9, 2014.

*Primary Examiner* — Khoa Huynh
*Assistant Examiner* — Megan Brandon
(74) *Attorney, Agent, or Firm* — HolzerIPLaw, PC

(57) ABSTRACT

A shoe sole can comprise one or more resiliently compressible elements received in a foundation and located by the foundation to underlie a portion of a foot, such as metatarsal heads, when the shoe is worn. The resiliently compressible element or elements can be shaped to reduce coupling of compression of adjacent regions of the resiliently compressible element. One or more plate elements can be positioned between the resiliently compressible elements and the foot, e.g. under the metatarsal heads. The plate elements can be separated from each other by spaces, such as slots, to reduce coupling of movement of adjacent plate elements. The plate elements can be elastically interconnected at the spaces between them. A plurality of lugs configured to contact the ground can be located on a lower surface of the foundation such that they are generally aligned with the plate elements. The plurality of lugs can be elastically interconnected.

32 Claims, 16 Drawing Sheets

(56) References Cited

U.S. PATENT DOCUMENTS

| | | | | |
|---|---|---|---|---|
| 6,438,873 | B1 * | 8/2002 | Gebhard et al. | 36/114 |
| 6,842,999 | B2 | 1/2005 | Russell | |
| 7,036,245 | B2 | 5/2006 | Russell | |
| 7,168,186 | B2 | 1/2007 | Russell | |
| 7,337,559 | B2 * | 3/2008 | Russell | 36/28 |
| 7,877,900 | B2 | 2/2011 | Russell | |
| 7,921,580 | B2 * | 4/2011 | Russell | 36/28 |
| 2003/0172548 | A1 | 9/2003 | Fuerst | |
| 2004/0006891 | A1 * | 1/2004 | Russell | 36/28 |
| 2004/0111920 | A1 * | 6/2004 | Cretinon | 36/30 R |
| 2004/0123495 | A1 * | 7/2004 | Greene et al. | 36/30 R |
| 2006/0096123 | A1 * | 5/2006 | Grandini | 36/3 B |
| 2006/0156580 | A1 * | 7/2006 | Russell | 36/28 |
| 2006/0156587 | A1 * | 7/2006 | Pawlus et al. | 36/100 |
| 2006/0168847 | A1 * | 8/2006 | Myers et al. | 36/3 B |
| 2006/0213088 | A1 * | 9/2006 | Grove et al. | 36/100 |
| 2007/0144037 | A1 * | 6/2007 | Russell | 36/28 |
| 2008/0209767 | A1 * | 9/2008 | Seamans | 36/103 |
| 2008/0216355 | A1 * | 9/2008 | Becker et al. | 36/102 |
| 2008/0289220 | A1 * | 11/2008 | Rivas et al. | 36/88 |
| 2009/0056166 | A1 * | 3/2009 | Edy et al. | 36/91 |
| 2009/0178303 | A1 * | 7/2009 | Hurd et al. | 36/107 |
| 2009/0193682 | A1 * | 8/2009 | Rosenbaum | 36/88 |
| 2009/0235557 | A1 * | 9/2009 | Christensen et al. | 36/29 |
| 2009/0282700 | A1 * | 11/2009 | Dillon et al. | 36/88 |
| 2010/0031530 | A1 | 2/2010 | Abshire | |
| 2010/0170106 | A1 * | 7/2010 | Brewer et al. | 36/28 |
| 2011/0010964 | A1 * | 1/2011 | Hardy et al. | 36/103 |
| 2011/0088287 | A1 * | 4/2011 | Auger et al. | 36/107 |
| 2011/0146110 | A1 * | 6/2011 | Geer | 36/25 R |
| 2011/0167678 | A1 * | 7/2011 | Peikert | 36/3 R |
| 2011/0265345 | A1 | 11/2011 | Russell | |

FOREIGN PATENT DOCUMENTS

| | | |
|---|---|---|
| EP | 0836395 | 12/2002 |
| EP | 2091372 | 11/2007 |
| EP | 1105009 | 2/2012 |
| HK | 1041795 | 4/2009 |
| IN | 206177 | 4/2007 |
| JP | 3789476 | 4/2006 |
| JP | 2010-508913 | 11/2007 |
| JP | 4524421 | 6/2010 |
| KR | 0516417 | 9/2005 |
| MX | 226084 | 2/2005 |
| RU | 2238016 | 10/2004 |
| TW | 123922 | 4/2001 |
| WO | 20090061103 A1 | 5/2009 |
| WO | 20100006906 A1 | 1/2010 |

* cited by examiner

SHOE SOLES FOR SHOCK ABSORPTION AND ENERGY RETURN

FIELD OF THE DISCLOSURE

The present disclosure generally relates to articles of footwear, and more particularly, to shoe soles that may be incorporated into athletic footwear, as an insert into existing footwear, or both.

BACKGROUND

In typical walking and running gaits, one foot contacts a support surface (such as the ground) in a stance mode while the other foot moves through the air in a swing mode. During the stance mode, the foot in contact with the support surface travels through three successive basic phases: strike, mid stance and toe off. With efficient running and natural running form, the foot may strike the ground forward of the heel. The heel of the foot may strike the ground in a walking gait, when the runner has adapted to wearing an elevated heel or when the running form is inefficient.

Running shoe designers have sought to strike a compromise between providing enough cushioning to protect the runner's foot, but not so much that the runner's foot will collapse into the shoe and compromise joint stability and body alignment.

Storing energy generated while running, jumping, etc., rather than merely dampening shock, can be beneficial to a wearer of a shoe. Rather than losing the energy, it is useful to store and retrieve that energy while allowing the feet greater sensory perception, as in barefoot running, to enhance athletic performance.

SUMMARY OF THE DISCLOSURE

Various exemplifying embodiments of shoe soles incorporating layered combinations of materials including at least one resiliently compressible portion are disclosed herein. Some embodiments of shoe soles incorporating features disclosed herein can provide improved speed of sole rebound when the sole undergoes a compression and decompression cycle in use, greater resistance to long-term deformation of a resiliently compressible layer, reduced manufacturing costs compared to some prior art shoe soles, or a combination of some or all of these benefits.

In some embodiments, a shoe sole can comprise a foundation, at least one resiliently compressible element, one or more plate elements, and a plurality of lugs. The foundation can comprise a recess configured to receive and locate the resiliently compressible element below a region of a foot. The plate elements can be located between the resiliently compressible element and the foot when the shoe is worn. The plate elements can be configured to transfer individually pressure between the foot and the resiliently compressible element. The lugs can be located on a side of the resiliently compressible material that is opposite the plate elements and can be configured to contact the ground.

In some embodiments, a shoe sole can comprise a foundation, at least one resiliently compressible element, one or more plate elements, and an outer sole. The foundation can comprise a recess configured to receive and locate the resiliently compressible element below a region of a foot. The plate elements can be located between the resiliently compressible element and the foot when the shoe is worn. The plate elements can be configured to transfer individually pressure between the foot and the resiliently compressible element. The outer sole can be located on a side of the resiliently compressible material that is opposite the plate elements and can be configured to contact the ground.

In some embodiments, such as those described above, the foundation and the resiliently compressible element can be sized and shaped to closely correspond to each other. In some embodiments, this close correspondence between the size and shape of the foundation and the resiliently compressible element can control expansion of the resiliently compressible element in a direction that is transverse to a direction of compression of the resiliently compressible element such that transverse expansion is inhibited, restricted, substantially prevented, or prevented.

In some embodiments where the shoe sole comprises one or more plate elements configured to transfer individually pressure between the foot and the resiliently compressible element, an area across which the plate elements apply pressure to the resiliently compressible element during compression of the sole against a support surface by the foot can be larger than an area over which pressure would be distributed if the foot acted upon the resiliently compressible element without the plate elements.

In embodiments wherein the shoe sole comprises a plurality of plate elements, such as those mentioned above, the plate elements can optionally be elastically interconnected. The elastic interconnections can urge one plate element toward a position aligned with an adjacent element or elements when moved out of alignment with the adjacent element or elements, whether by movement out of alignment from a nominal plane or surface, by increased separation in a direction along a nominal plane or surface, or a combination thereof. Such arrangements can increase the speed of rebound from compression of the shoe sole and improve the return of energy to the shoe wearer.

In embodiments wherein the shoe sole comprises a plurality of lugs, such as those mentioned above, the lugs can optionally be elastically interconnected. The elastic interconnections can urge one lug toward a position aligned with an adjacent lug or lugs when moved out of alignment with the adjacent lug or lugs. Such arrangements can increase the speed of rebound from compression of the shoe sole and improve the return of energy to the shoe wearer. The ground reaction force of the wearer's foot acting on the shoe as it engages the ground (impact) can cause one or more of the lugs to be forced upward into sole. This force is resisted and stored by elastic portions, if any, which connect a lug to an adjacent lug or lugs and by the resiliently compressible material. Some embodiments including such arrangements can demonstrate improved shock attenuation and greater efficiency than prior art soles.

In embodiments wherein the shoe sole comprises a plurality of plate elements and a plurality of lugs, such as those mentioned above, the plate elements and lugs are preferably generally aligned such that as the shoe sole is compressed against a support surface by a foot wearing the shoe, at least a portion of the resiliently compressible element is compressed between a generally aligned plate element and lug.

In some embodiments, a shoe sole can have at least one resiliently compressible element removably received in a foundation such that, between uses of the shoe, one resiliently compressible element can be removed and replaced with another resiliently compressible element that is substantially the same as the first or different from the first. In some such embodiments and in some other embodiments, a plate or plate elements can be attached to an insole or sockliner such that the plate or plate elements can be removed with the insole, and then inserted again to the shoe with the plate or plate elements appropriately positioned relative to the at least one resiliently compressible element. This feature can, in some embodiments, facilitate an exchange of at least one resiliently compressible element with another.

In some embodiments, a shoe can comprise an upper and a sole. The upper can be configured to receive a foot. The sole can be attached below the upper and comprise a foundation layer, a resiliently compressible element, a plate, and a plurality of lugs. The foundation layer can define a longitudinal axis extending from a heel portion to a toe portion of the foundation layer. The foundation layer can have an upper surface facing the upper and a lower surface. The foundation layer can define a recess in the upper surface in a forefoot region of the foundation layer. The resiliently compressible element can be positioned in the recess. The resiliently compressible element can have an upper surface and a lower surface. The plate can be provided over the resiliently compressible element between the resiliently compressible element and the upper. The plate can have a plurality of longitudinal slots each extending from a toe end of the plate partially toward a heel end of the plate to partially divide the plate into articulating portions. The plurality of lugs can be configured to contact the ground and can be located on the lower surface of the foundation layer. The lugs can be generally aligned with the articulating portions of the plate.

BRIEF DESCRIPTION OF THE DRAWINGS

The above-mentioned and other features of the invention disclosed herein are described below with reference to the drawings of the preferred embodiments. The illustrated embodiments are intended to illustrate, but not limit, the invention. The drawings contain the following figures.

DESCRIPTION OF CERTAIN EXEMPLIFYING EMBODIMENTS

Figure 1:
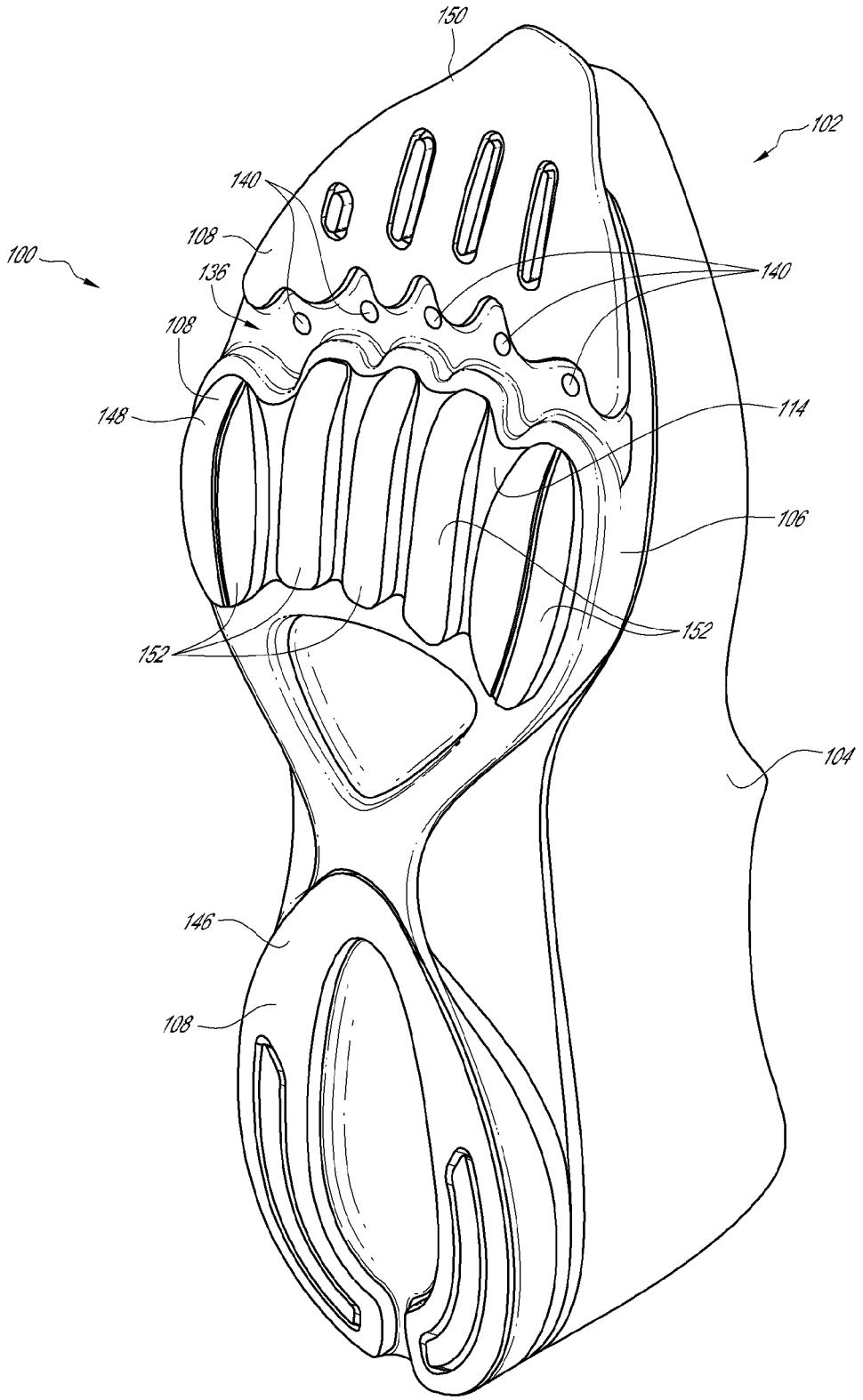
FIG. 1 is a lower perspective view of an embodiment of a shoe sole.
Figure 2:
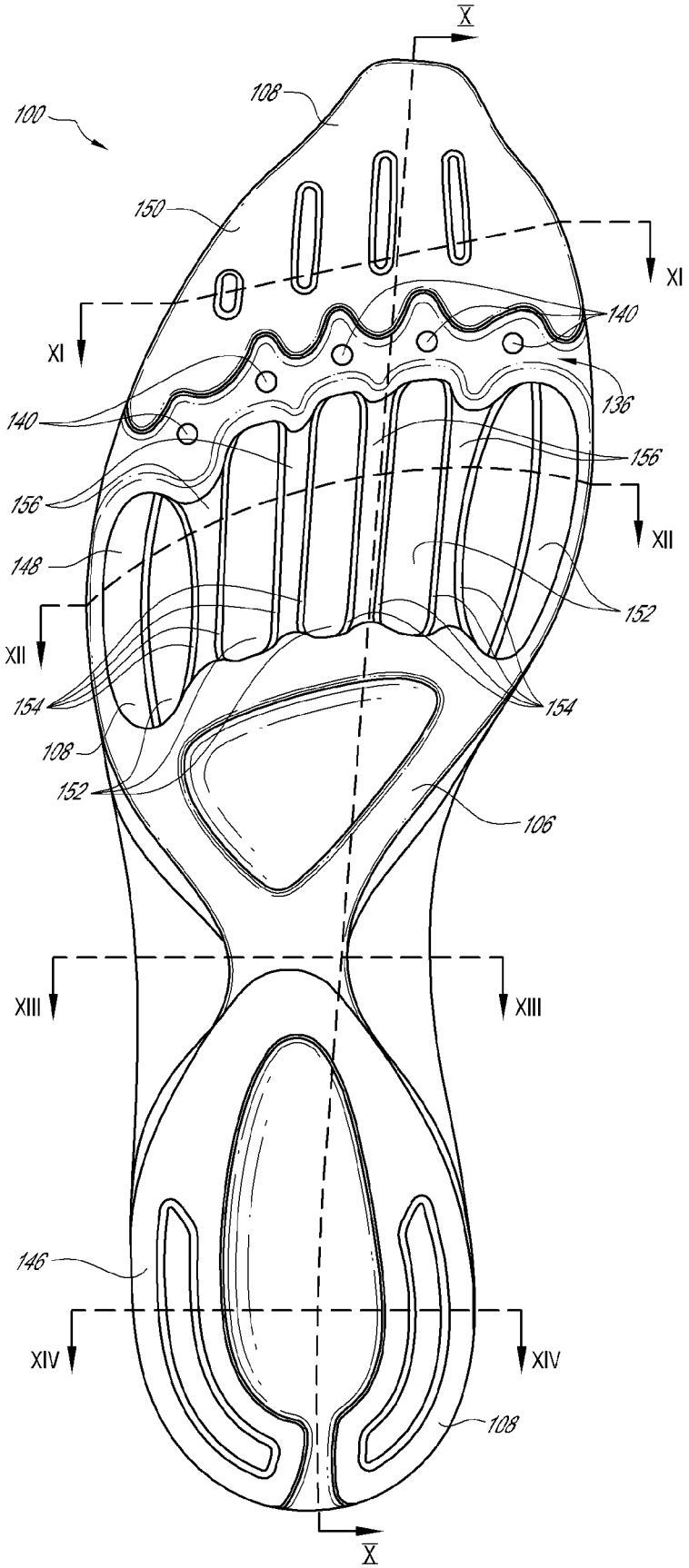
FIG. 2 is a bottom plan view of the shoe sole of FIG. 1.
Figure 3:
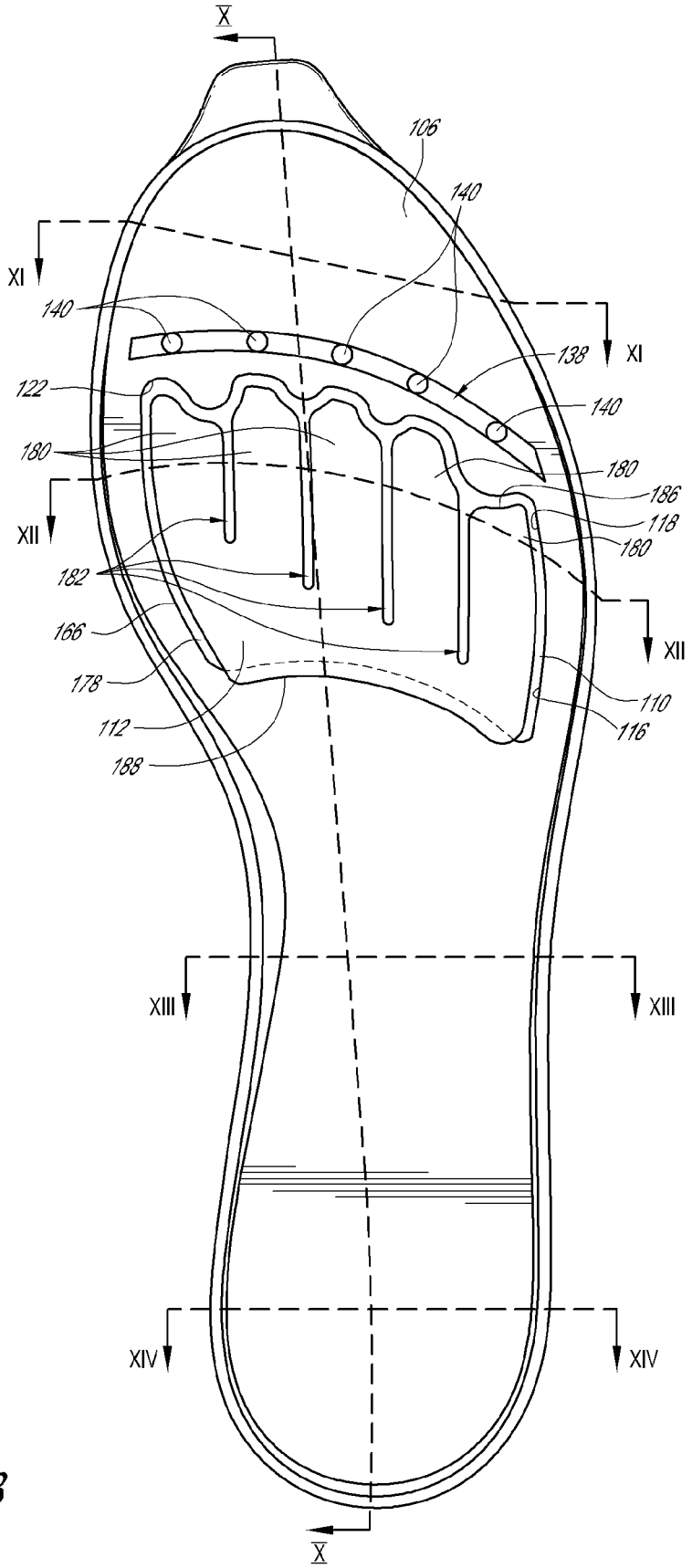
FIG. 3 is a top plan view of the shoe sole of FIG. 1 with an upper of the shoe omitted and showing a plate and a resiliently compressible element.

FIGS. 1-3 illustrate an embodiment of a shoe 102 exemplifying various inventive aspects and features. As illustrated in FIG. 1, the shoe 102 can comprise a sole 100 and an upper 104. The shoe sole 100 can comprise a foundation 106, an outsole 108, at least one resiliently compressible element 110, and at least one plate 112. In some embodiments, the sole 100 can comprise one or more elastic membranes 114, which can be integrally formed with or separately formed then attached to the foundation 106, the outsole 108, the plate 112, or a combination of them, such as further described below for example. The upper 104, shown schematically in FIG. 1, is omitted from FIGS. 2-3.

In the embodiment illustrated in FIGS. 1-3, the foundation 106 can form a layer of the sole that underlies the entire foot or substantially the entire foot between toe and heel and between lateral and medial sides. In some embodiments, the foundation 106 can comprise a plurality of foundation elements, while in other embodiments the shoe can comprise a single foundation element. The foundation 106 can be formed of expanded or foam rubber, such as EVA, or other materials having material properties harder or softer, more rigid, or more flexible, than expanded or foam rubber in some embodiments. In some embodiments, the foundation 106 can be a midsole of the sole.

The foundation 106 can comprise a recess 116 (see FIGS. 3-5, 10 and 12) configured to receive at least one resiliently compressible element 110. The recess 116 can comprise a peripheral wall 118 and a floor 120. The peripheral wall 118 can, in some embodiments such as that illustrated in FIG. 5 for example, completely surround the recess 116 and a resiliently compressible element 110. In some embodiments, however, the peripheral wall 118 may only partially surround the recess 116 and the resiliently compressible element 110. The peripheral wall 118 and floor 120 can cooperate to form a cavity in the foundation 106 of a size sufficient to receive part, substantially all, or all of one or more resiliently compressible elements 110. Preferably, the recess 116 is sized and shaped to closely correspond to a size and shape of the resiliently compressible element 110. In some embodiments the size and shape of the recess 116, for example by its close correspondence to the size and shape of the resiliently compressible element 110, can control movement of the resiliently compressible element or elements 110 within the recess 116. In some embodiments the size and shape of the recess 116, for example by its close correspondence to the size and shape of the resiliently compressible element 110, can control expansion of the resiliently compressible element or elements 110 in a direction transverse to a direction of compression of the resiliently compressible element or elements 110. In some embodiments, the foundation can inhibit, restrict, substantially prevent, or prevent transverse expansion of the resiliently compressible element or elements when compressed in a generally vertical direction.

Figure 4:
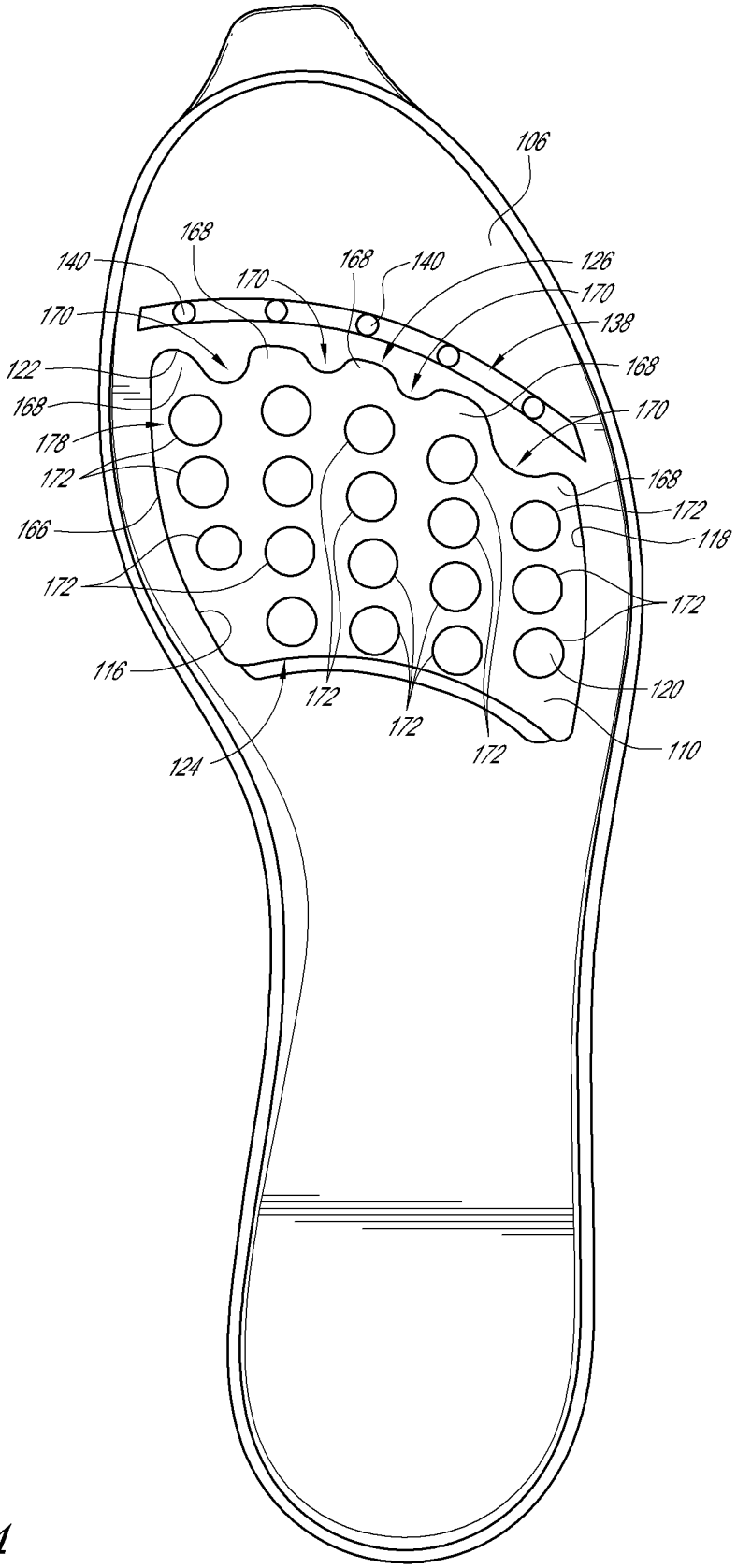
FIG. 4 is a top plan view of a shoe sole, similar to FIG. 3, but with the plate omitted and showing the resiliently compressible member.
Figure 5:
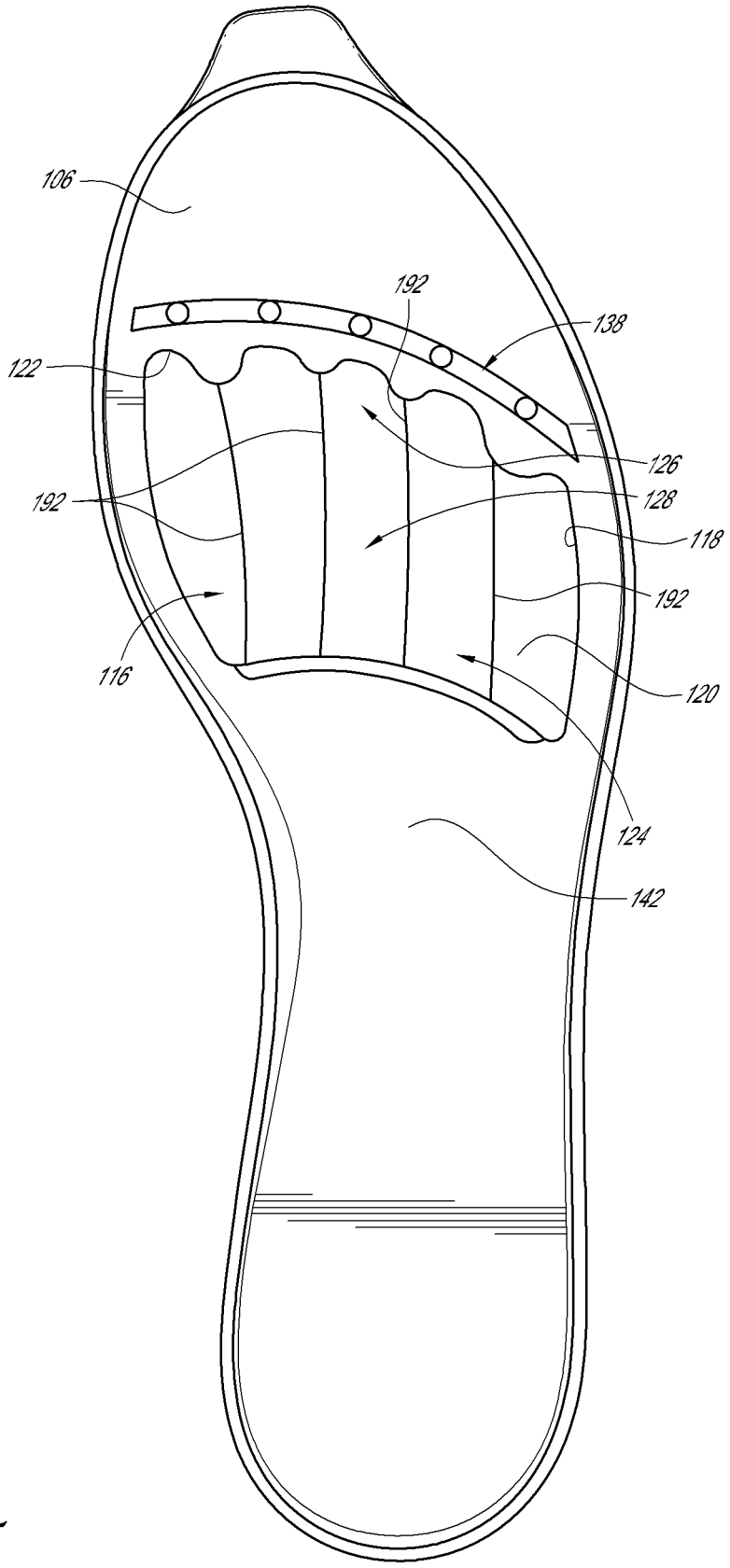
FIG. 5 is a top plan view of a shoe sole, similar to FIGS. 3 and 4, with the plate and the resiliently compressible member omitted.
Figures 6, 7:
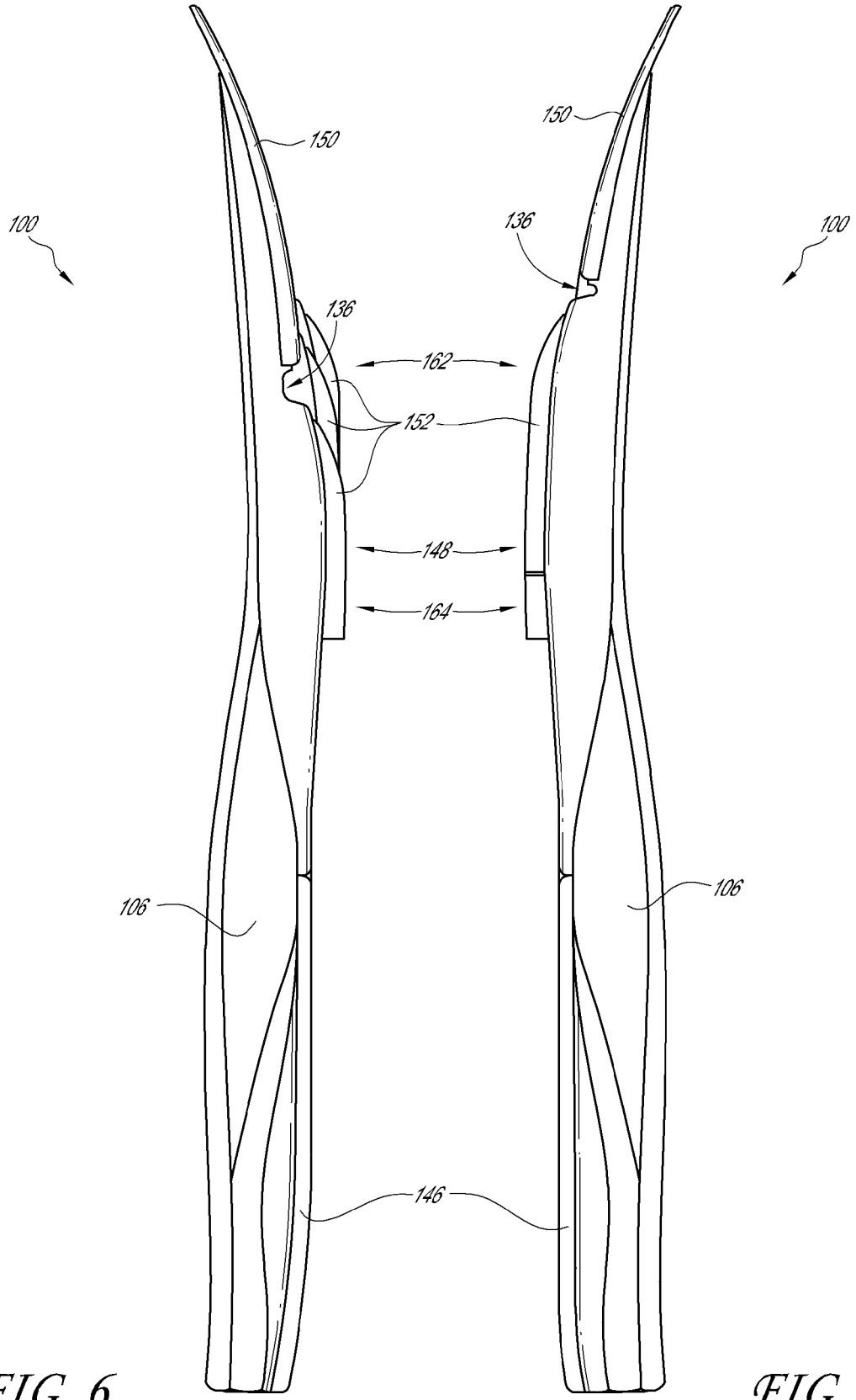
FIG. 6 is a lateral side view of the shoe sole of FIGS. 1-3.
FIG. 7 is a medial side view of the shoe sole of FIGS. 1-3.
Figure 8:
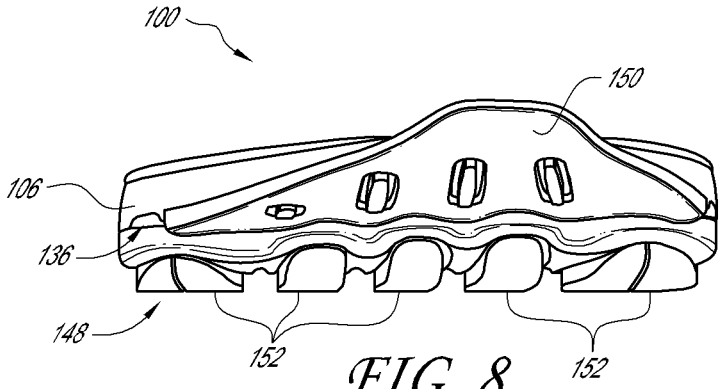
FIG. 8 is a front view of the shoe sole of FIGS. 1-3.
Figure 9:
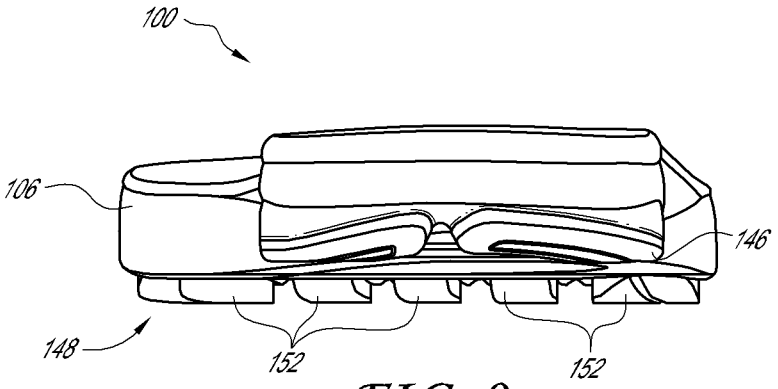
FIG. 9 is a rear view of the shoe sole of FIGS. 1-3.

In some embodiments, the peripheral wall 118 of the recess 116 and the foundation 106 can comprise curves 122, such as illustrated in FIGS. 3-5 for example, that extend generally around locations where metatarsal heads of a foot would rest upon the shoe sole 100 when worn. The curves 122 can include convex portions around the ends of the metatarsal heads and concave portions generally between the metatarsal heads.

Figure 10:
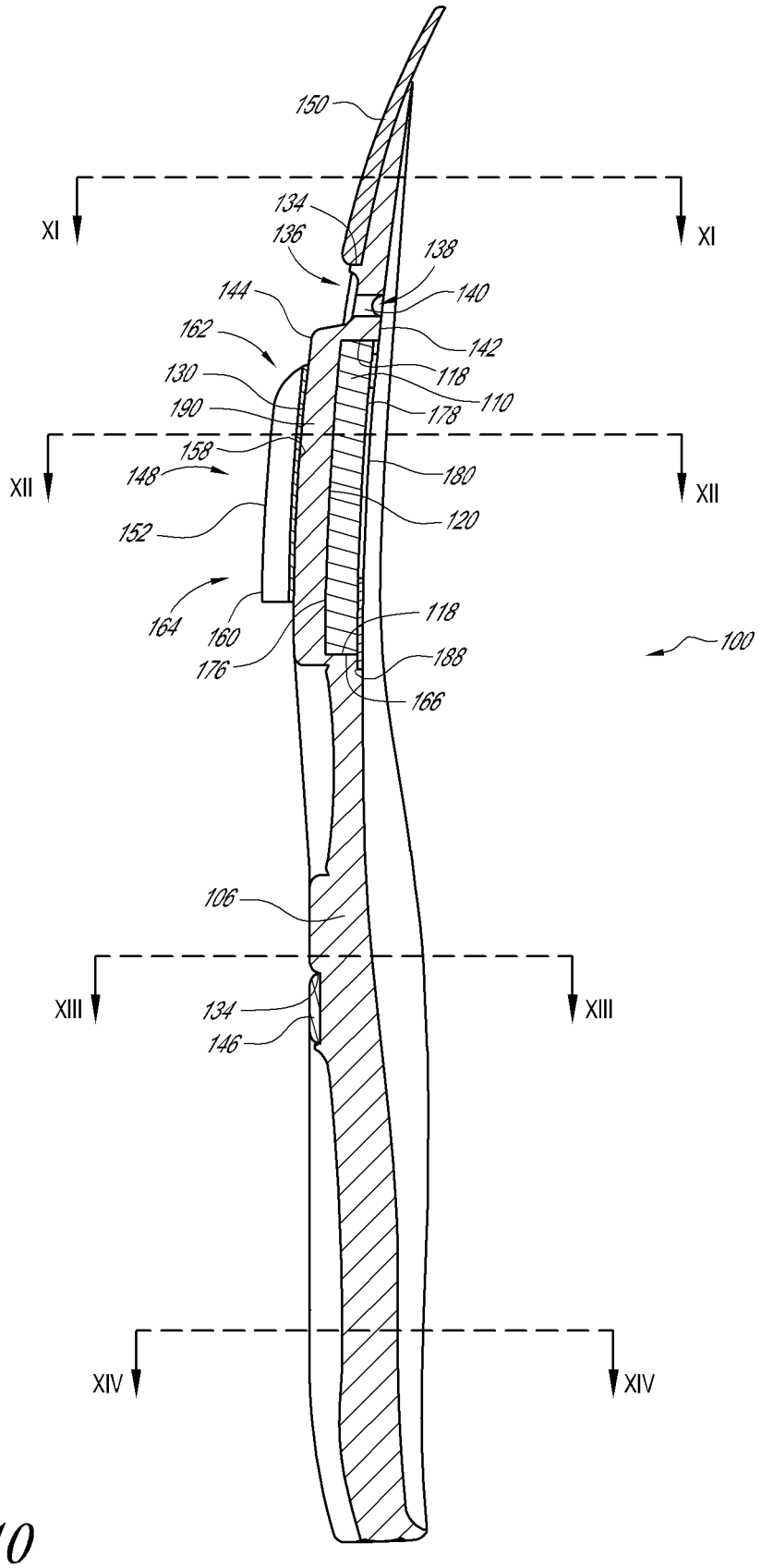
FIG. 10 is a cross-sectional view of the shoe sole of FIGS. 1-3 along the line X-X shown in FIGS. 2 and 3.
Figure 12:
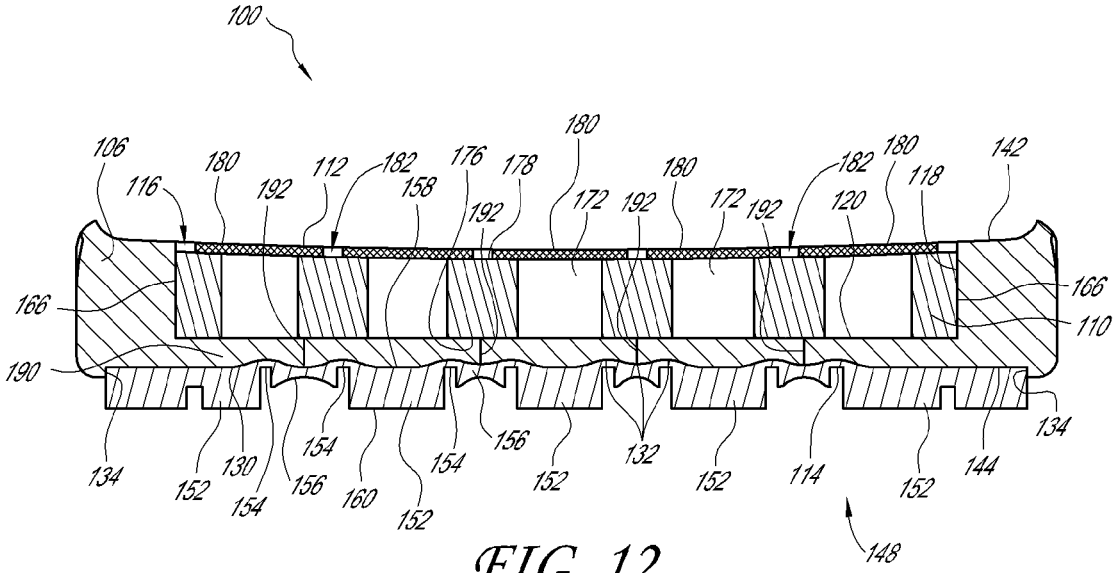
FIG. 12 is a cross-sectional view of the shoe sole of FIGS. 1-3 along line XII-XII shown in FIGS. 2 and 3.
Figure 13:
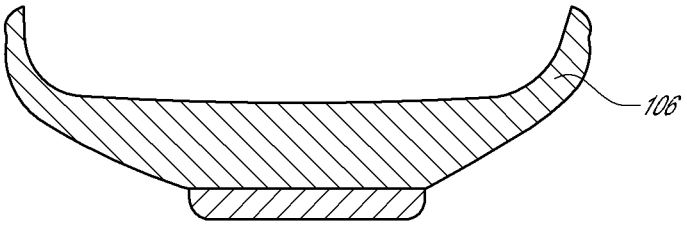
FIG. 13 is a cross-sectional view of the shoe sole of FIGS. 1-3 along the line XIII-XIII shown in FIGS. 2 and 3.

The floor 120 of the recess 116 in the foundation 106 can be generally or substantially planar, in some embodiments such as the embodiment of FIGS. 10 and 12. In some embodiments, the floor 120 can have other shapes. For example, the floor 120 can have undulations positioned under metatarsal bones of the foot, in between metatarsal bones of the foot, or both when the shoe 102 is worn.

In some embodiments, the floor 120 can be spaced from a nominal upper surface of the foundation 106 such that the depth of the recess 116 is substantially consistent or consistent across a length of the recess, a width of the recess, or both. In some embodiments, the recess 116 can be spaced unevenly from a nominal surface of the foundation 106. For example, a rearward end 124 of the recess 116 can be deeper or shallower than a forward end 126 of the recess 116. A central portion 128 of the recess 116 can be deeper or shallower than one or both the forward end 126 and the rearward end 124 of the recess 116 in some embodiments.

In some embodiments, such as the embodiment illustrated in FIGS. 10 and 12, the floor 120 of the recess 116 can be unevenly spaced from a surface 130 on a side of the foundation 106 opposite the recess 116. For example, the surface 130 can comprise one or more curves. In some embodiments, the thickness of the foundation 106 between the surface 130 and the floor 120 of the recess 116 can be evenly or substantially evenly spaced along in a longitudinal direction (e.g. generally between heel and toe of the shoe) as illustrated in FIG. 10, while including a curves 132 in a transverse direction (e.g. generally between lateral and medial sides of the shoe) as illustrated in FIG. 12. As shown in FIG. 12, a plurality of curves 132 can be convex at locations generally under where the metatarsal heads would rest on the sole 100 when the shoe is worn, and a plurality of curves can be concave at locations generally between the metatarsal heads. In some embodiments, the separation between the surface 130 and the floor 120 can be equal or substantially equal along the length and breadth of the recess 116.

As illustrated in FIG. 12, for example, the foundation 106 can comprise one or more walls 134 that surround all, substantially all, or a portion of an outsole portion 108. In some embodiments, the walls 134 can facilitate location of the outsole 108 on the foundation 106, inhibit movement of the outsole 108 along the foundation 106, or both.

As illustrated in FIG. 10, the foundation 106 can comprise a plurality of grooves 136, 138 in some embodiments. For example, a groove 136 is illustrated in a lower surface on the foundation 106 in FIGS. 2 and 10. Also for example, an upper groove 138 is shown in an upper surface of the foundation 106 in FIGS. 3-5 and 10. The grooves 136, 138 can facilitate natural metatarsal to toe leverage and flexion of a foot wearing the shoe 102 in some embodiments.

In some embodiments, the foundation 106 can comprise one or more holes 140 to facilitate air flow, fluid drainage, or both through the foundation 106. The holes 140 can extend completely through the foundation 106 between an upper surface 142 and a lower surface 144 of the foundation 106. In some embodiments where the holes are present, the holes can provide ventilation through the foundation 106. In some embodiments, as illustrated in FIGS. 2, 3, and 10 for example, the holes 140 can be positioned in the grooves 136, 138 (if present). In embodiments where the holes 140 are positioned in the groove 138 in the upper surface of the foundation 106, the groove 138 can facilitate flow of air or fluid to the holes 140. In embodiments where the holes 140 are positioned in the groove 136 in the lower surface 144 of the foundation 106, the groove 136 can facilitate egress of air and fluid from the holes 140, even when the shoe 102 is in contact with the ground or other support surface.

Figure 14:
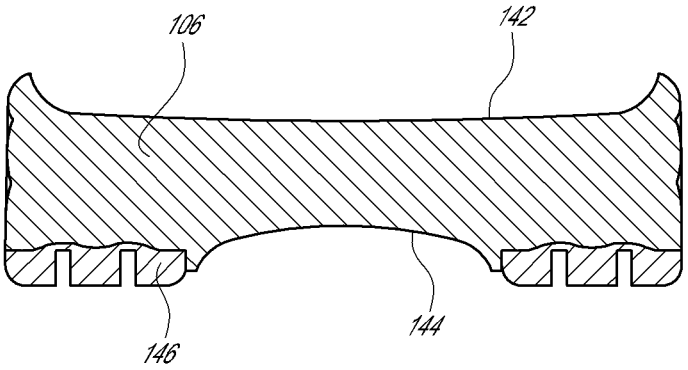
FIG. 14 is a cross-sectional view of the shoe sole of FIGS. 1-3 along the line XIV-XIV shown in FIGS. 2 and 3.
Figure 15:
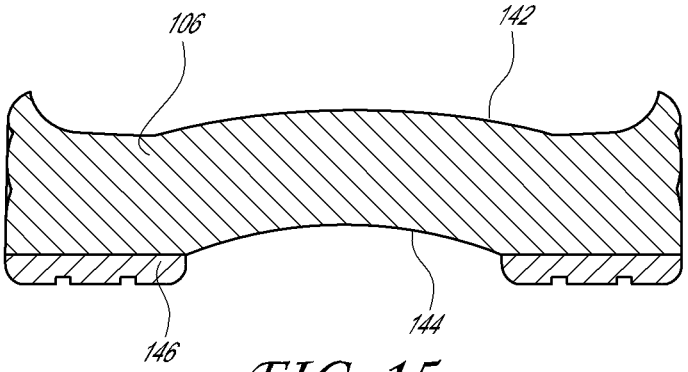
FIG. 15 is a cross-sectional view, similar to FIG. 14, illustrating a shoe sole with a heel portion according to an embodiment.

In some embodiments, the upper surface 142 of the foundation 106 can comprise generally flat or slightly concave portion, as illustrated in FIG. 14, that underlies the heel of the foot when the shoe is worn. In some embodiments, as illustrated in FIG. 15 for example, the upper surface 142 of the foundation 106 can have generally convex portion that underlies the heel of the foot when the shoe is worn. In some embodiments, the lower surface 144 of the foundation 106 can comprise a concave portion that underlies the heel of the foot when the shoe is worn, as illustrated in FIGS. 14 and 15 for example.

Figure 11:
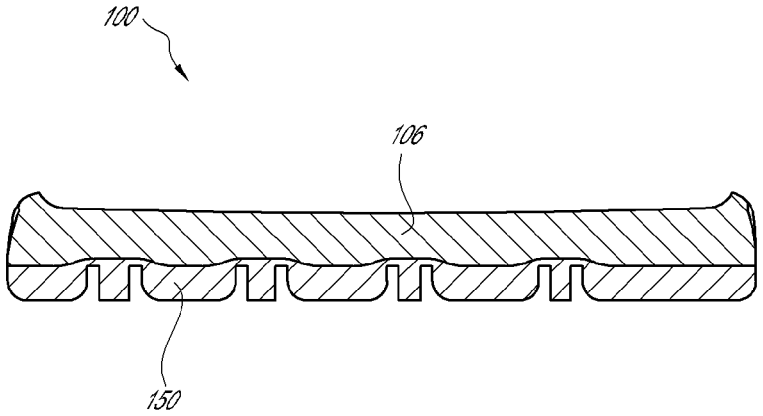
FIG. 11 is a cross-sectional view of the shoe sole of FIGS. 1-3 along line XI-XI shown in FIGS. 2 and 3.

The outsole 108 of the sole 100 illustrated in FIGS. 1 and 2 comprises a plurality of outsole portions. More particularly, the sole 100 illustrated in FIGS. 1 and 2 comprises an outsole portion 146 under a heel region of the sole (FIG. 14), an outsole portion 148 underlying a metatarsal region (FIG. 12), and an outsole portion 150 underlying a toe region of the sole (FIG. 11). The outsole 108 is preferably formed of material more durable than the foundation 106. The outsole portions can be composed of durable materials, such as, for example, high-density rubber, polyurethane, carbon rubber, natural gum rubber, blown rubber, rubber-urethane compounds, fabric-rubber composites, fabric-polymer composites, fiber-polymer composites, fiber-rubber composites, or a combination thereof. Composite materials may incorporate fibers of carbon, glass, Kevlar, boron, or a combination thereof.

In some embodiments, the outsole 108 can comprise one or more lugs 152, shown in FIGS. 1, 2, 8, and 9 for example. In some embodiments, the lugs 152 can be formed with the outsole portion 148 underlying the metatarsal region of the sole 100, as illustrated in FIG. 12. In some embodiments, lugs 152 can be formed with the outsole portion 146 underlying the heel, the outsole portion 150 underlying the toes, or both, in addition to or in alternative to the outsole portion 148 underlying the metatarsal region of the sole 100. In some embodiments, such as that illustrated in FIG. 12, a plurality of lugs 152 can be formed integrally with each other as a single piece. The lugs 152 can be formed independently of each other and separately attached to the sole 100 in some embodiments.

Figure 16:
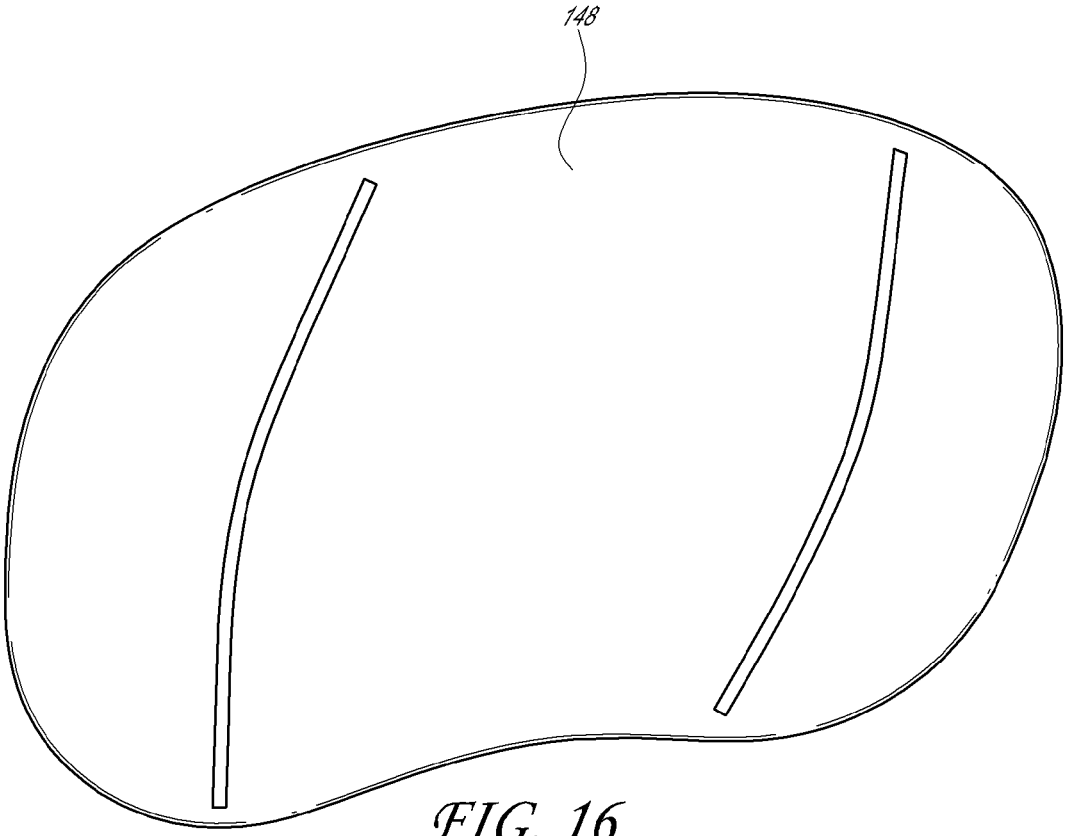
FIG. 16 is a bottom view of an outsole portion according to an embodiment.
Figure 18:
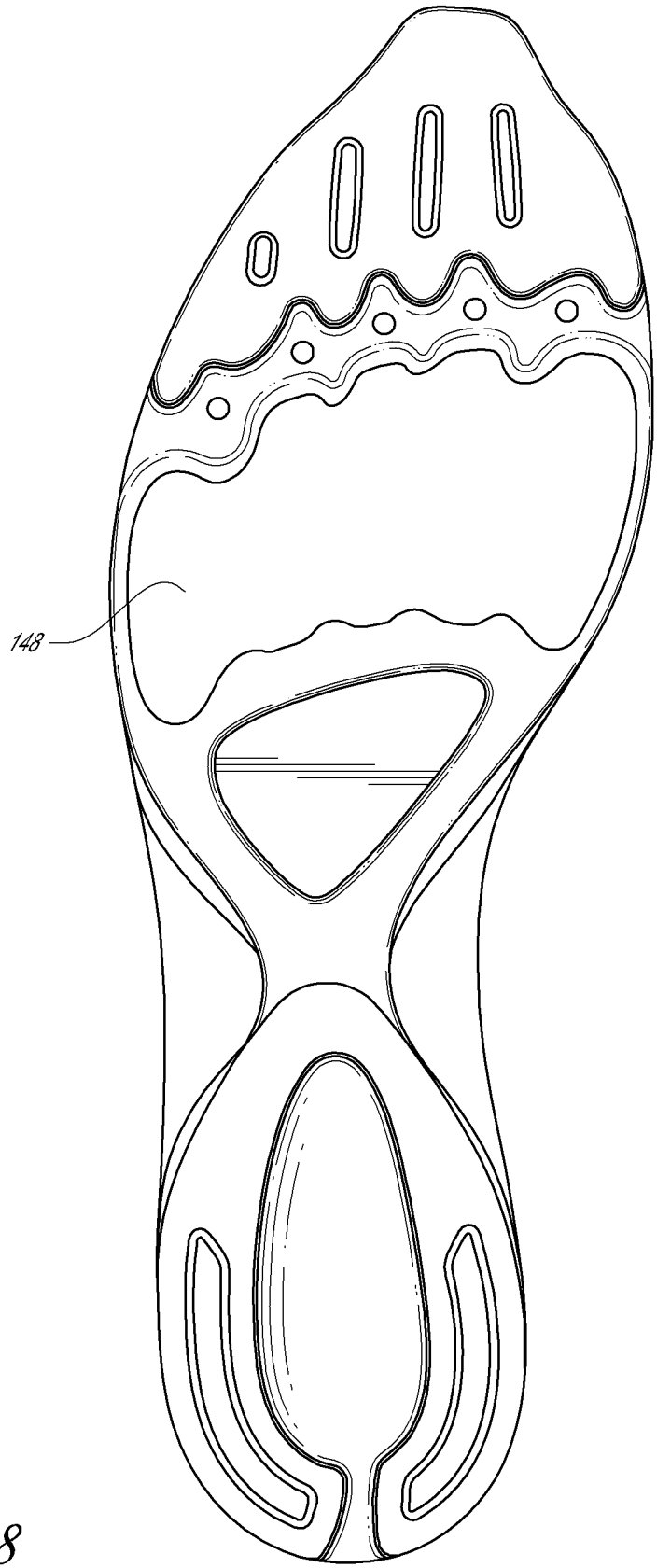
FIG. 18 is a bottom view of a shoe sole according to an embodiment.

As illustrated in FIGS. 16 and 18, the metatarsal outsole portion 148 can omit lugs 152 is some embodiments. In FIG. 18, the outsole portion 148 is shaped to correspond generally to the metatarsal heads of the foot and the spaces between the metatarsal heads when the shoe is worn.

Figure 17:
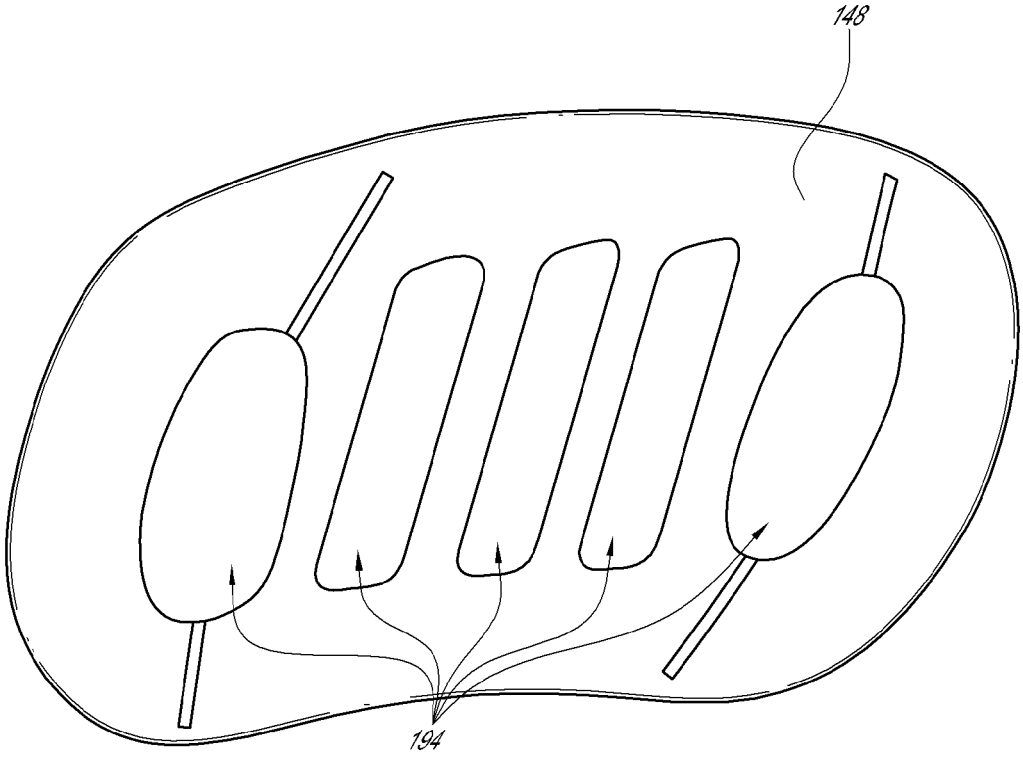
FIG. 17 is a bottom view of an outsole portion according to an embodiment.

In some embodiments, the lugs 152 can be formed separately from other portions of the outsole 108. For example, as illustrated in FIG. 17, the metatarsal outsole portion 148 can comprise a plurality of openings 194 that are sized and shaped such that lugs 152 that are formed separately from the outsole portion 148 can extend through the metatarsal outsole portion 148 is some embodiments.

The lugs 152 can be removable from the foundation 106 by a user in some embodiments. In some embodiments, the resiliently compressible element or elements 112 and the lugs 152 can be attached together such that they can be positioned together in the foundation 106 and removed together from the foundation 106 to provide the shoe with portions of both the outsole and midsole that are removable and replaceable. In some embodiments, the lugs 152 can be attached to an elastic membrane such that they can be positioned together in the foundation 106 and removed together from the foundation 106. In some of those embodiments, the elastic membrane can be attached to one or more resiliently compressible elements 110 such that the lugs, the elastic membrane, and the one or more resiliently compressible elements can be positioned together in the foundation 106 and removed together from the foundation 106. In some embodiments, the attachment between some or all of the lugs, the elastic membrane, and one or more resiliently compressible elements so that they can be positioned together in the foundation and removed together from the foundation can to provide the shoe with portions of both the outsole and midsole that are removable and replaceable by a user and, in some of those embodiments, without the aide of tools.

For example the foundation 106 can, in some embodiments, have openings that are sized and positioned such that lugs 152 can be received in those openings. If a metatarsal portion 148 is also provided then the metatarsal portion can be configured as illustrated in FIG. 17 for example, such that the lugs can extend through both the foundation and the metatarsal portion 148. In some embodiments that include a foundation 106 with openings for the lugs 152 and an outsole portion 148 with openings 194 for the lugs, the openings in the foundation and the openings in the outsole portion can be substantially the same size and shape and substantially aligned with each other to permit the lugs to extend through both the foundation and the outsole. In some embodiments wherein the lugs 152 can be removable from the foundation 106 by a user, the lugs 152 can be positioned in the openings in the foundation 106 from the top side, which is thereafter covered by a sock liner, one or more plates, or both.

In embodiments that comprise lugs 152, a thickness of the lugs 152 (as measured between an upper surface 158 and a lower surface 160, see FIG. 12) can vary across a width of the lug 152 between a lateral and a medial side (as illustrated in FIG. 12), along a length of the lug 152 (as illustrated in FIG. 10), or both. As illustrated in FIG. 12 for example, a lug 152 can have a greater thickness near its lateral and medial edges than in a central portion of the lug. In some embodiments, such a difference in thickness across a width of the lug 152 can result from a concave shape of the upper surface 158 of the lug, as illustrated in FIG. 12 for example. As illustrated in FIG. 10, all or a portion of a lug can have a thickness which reduces with proximity to a forward end 162. FIG. 10 illustrates a lug 152 comprising a portion near a rearward end 164 having a generally or substantially constant thickness, and a portion near the forward end 162 with a thickness which reduces with proximity to the forward end 162. In embodiments with tapering of the thickness of the lug near a forward end 162, the tapering of the lug 152 can assist in transition between the lugs 152 and a portion of the sole located forward of the lugs 152 (such as the toe portion illustrated in the embodiment of FIGS. 1-3) as the sole 100 rolls along the ground. In some embodiments, some or all of the lugs 152 can have a substantially constant thickness across their length, width, or both. The lugs 152 can have a maximum thickness at their thickest location of about 7 millimeters or less, between about 3 millimeters and about 6 millimeters, or between about 4 millimeters and about 5 millimeters, in some embodiments. In some embodiments, the maximum thickness of the lugs 152 can be about 4.5 millimeters. The lugs can all have the same maximum thickness in some embodiments. In other embodiments, some of the lugs 152 can have a maximum thickness which is greater than or less than the maximum thickness of other lugs.

In some embodiments, as illustrated in FIG. 2 for example, the lugs 152 can correspond in number to the metatarsal bones of the human foot and can be located to underlie a portion of the sole 100 which is acted upon by the metatarsal heads of a foot during use of the shoe. Although the illustrated embodiment comprises five lugs, some embodiments can comprise more or fewer than five lugs.

The lugs 152 can have a shape (viewed from the bottom of the shoe) that is elongated with a major dimension of the lug 152 that is generally oriented in a longitudinal direction (e.g. generally between heel and toe of the shoe) and a minor dimension is generally oriented in a transverse direction (e.g. generally between lateral and medial sides of the shoe). As illustrated in FIG. 2 for example, the lugs can have a generally oval shape or a generally rectangular shape, although other shapes may be used in some embodiments. As shown in FIG. 2 for example, among a plurality of lugs, some of the lugs 152 can have different shapes than others.

Figure 19:
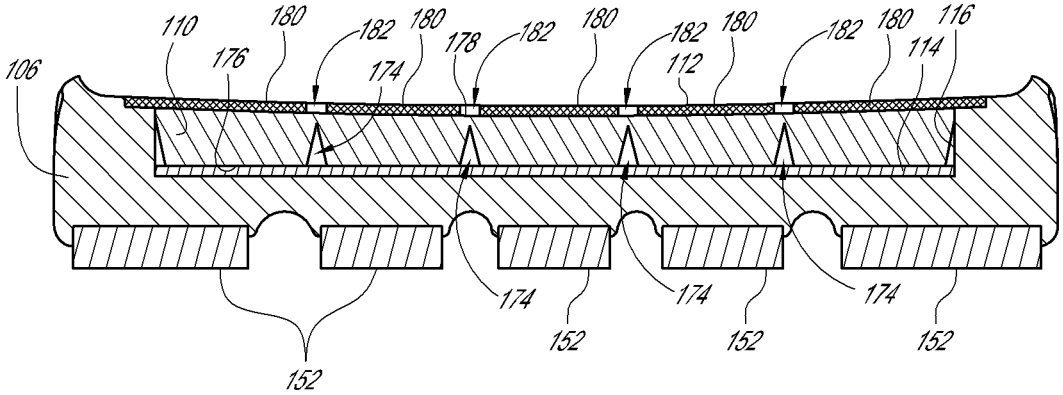
FIG. 19 is a cross-sectional view, similar to FIG. 12, of an embodiment of a shoe sole.
Figure 22:
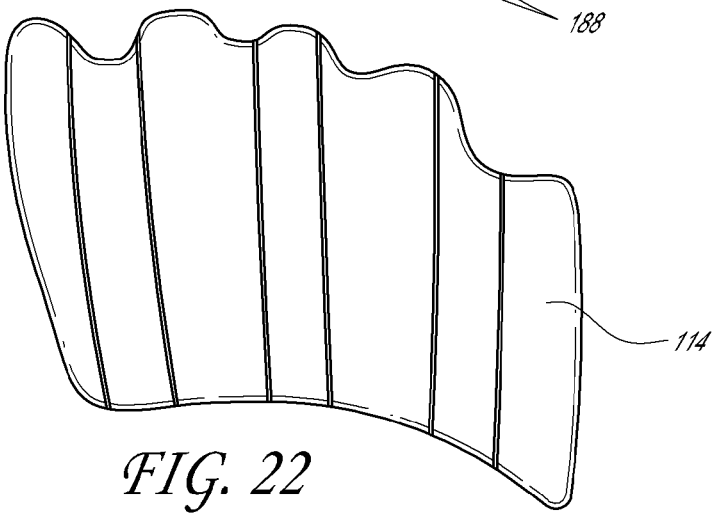
FIG. 22 is a top view of an elastic membrane according to an embodiment.

In some embodiments, a plurality of lugs 152 can be interconnected by one or more elastic membranes. For example, elastic portions 154 can extend between and interconnect adjacent lugs 152. The lugs 152 and elastic membrane 114 are integrally formed or separately formed. FIG. 19 illustrates an embodiment wherein an elastic membrane 114 is formed separately from the lugs 152. FIG. 22 illustrates an elastic membrane 114 formed separately from the lugs and including a plurality of lines to provide guides for location the lugs when attaching them to the elastic membrane 114. The lines can of slightly greater thickness than adjacent portions of the plate 112 or can be flush on the surface of the elastic membrane 114.

In some embodiments, the elastic membrane 114 can be attached to the foundation 106 such that movement of the membrane 114 is restricted relative to the foundation 106. For example, the elastic membrane 114 can be adhered to the foundation 106 using an adhesive such as, for example, polyurethane adhesive, rubber- or urethane-based contact cement, or epoxy.

When the lugs 152 are attached to an elastic membrane 114, whether the elastic membrane 114 is integrally formed with the lugs or formed independently of the lugs 152, the lugs are preferably attached to the elastic membrane 114 such that movement of the lugs 152 along the elastic membrane 114 is inhibited, restricted, or preferably prevented. In some embodiments, as illustrated in FIG. 19 for example, the elastic membrane 114 can be positioned between the one or more resiliently compressible elements 110 and the lugs 152, and can be spaced from the lugs 152. As illustrated in FIG. 19, the foundation 106 can separate the elastic membrane 114 from the outsole 108. The elastic membrane can be adhered or otherwise attached to the foundation 106, the one or more resiliently elastic elements 110, the outsole 109, or a combination thereof. Although not illustrated, in some embodiments, the elastic membrane can be adhered or otherwise directly attached to both the one or more resiliently elastic elements 110 and the outsole 108, for example in embodiments wherein the foundation 106 does not separate them.

The elastic membrane 114 and other elastic portions disclosed herein can be made of any highly resilient elastic material such as rubber, synthetic rubber, DuPont Hytrel® and highly resilient elastic foams. The elastic response of an elastic membrane of a given material depends, at least in part, on its hardness and thickness. In some embodiments, the elastic portions can have a thickness of about 2 millimeters or less, between about 0.5 millimeters and about 1.5 millimeters, between about 0.8 millimeters and about 1.2 millimeters, or about 1 millimeters. In some embodiments, the elastic membrane can be made of elastic rubber have a thickness of about 1.0 millimeters.

In some embodiments, the outsole 108 can include portions 156 which extend downwardly from the elastic portions 154 between the lugs 152. The portions 156 may protect the elastic membrane 114 from damage from the environment, e.g., rocks or other abrasive elements. The portions 156 can be stiffer than the adjacent elastic portions 154. In some embodiments, the portions 156 can be stiffer than the adjacent elastic portions because of their thickness, the material from which they are formed, or both. In some embodiments where the portions 156 are stiffer than the adjacent elastic portions 154, the portions 156 can reduce the coupling of movement of adjacent lugs 152.

In some embodiments, one or more resiliently compressible elements 110 can form a layer of the sole positioned between a region of a foot and the outsole. The one or more resiliently compressible elements 110 can be a sheet or block of material in some embodiments.

The one or more resiliently compressible elements 110 are preferably made of a material that quickly rebounds from a compressed state. For example, the resilient compressible element 110 can be formed of polyurethane foam, silicone gel, high rebound ethylene vinyl acetate, foamed rubber, polyolefin foam, polymer foam, polymer blend foam or similar materials or composites of those materials in some embodiments. The one or more resiliently compressible elements 110 can be formed by any of a variety of operations, such as those known in the art. For example, the resiliently compressible elements can be cut, punched, or otherwise formed from a sheet or block of material or can be molded, such as by injection or compression molding.

The properties of a particular material of the resiliently compressible element can affect the sensation experienced by the wearer of the shoe during use. For example, the feeling or "ride" can be made firmer or softer by selection of a material with an appropriate hardness for the resiliently compressible element 110. For example, a 40 durometer element would provide a softer ride than a 70 durometer element. In some embodiments, the resiliently compressible element 110 can have a hardness of about 45 durometer. In some embodiments, the resilient compressible element can have a hardness of about 35 durometer. The material properties of the resiliently compressible element 110 can be selected based on the attributes of the wearer (e.g., weight) and the intended use characteristics (e.g., type of running surface). For example, a different resiliently compressible element may be desired for road use than for use on unpaved trails. In some embodiments, the resiliently compressible element 110 can be configured to influence or control pronation, for example to limit or inhibit late-stage pronation. In some embodiments, the hardness of the resiliently compressible element or elements 110 can be varied between lateral and medial sides of the shoe. In some embodiments, the hardness of the resiliently compressible element or elements can be varied across a width of the shoe between medial and lateral sides by including a sloping transition between two materials of different properties (e.g., a hardness). In some embodiments, all of the resiliently compressible element or elements 110 can have a thickness that is about the same. In some embodiments, a compressible element 110 can have a different thickness than another element 110. One or all of the resiliently compressible elements can have a thickness of between about 1 millimeters and about 9 millimeters, between about 3 millimeters and about 7 millimeters, or about 5 millimeters in some embodiments.

In some embodiments, a shoe sole 100 can be configured to allow a user to exchange resiliently compressible elements 110 between uses of the shoe 102. For example, the resiliently compressible element or elements 110 can be removably received within the recess 116 of the foundation 106 such that the resiliently compressible element or elements 110 can be removed from the foundation 106 without the use of tools and without damaging the foundation 106 or the resiliently compressible element or elements 110. Where this feature is incorporated into a sole 100, the user can advantageously adjust the sole to changing attributes of the wearer or changes in the intended use environment.

Although a single resiliently compressible element 110 is shown in the illustrated embodiments, one or more resiliently compressible elements 110 can be positioned below the heel and toe areas of the sole 100 in addition to or in alternative to being positioned below the metatarsal region of the shoe. Also, notwithstanding a single resiliently compressible element 110 is shown in the illustrated embodiments, a plurality of resiliently compressible elements 110 can be received in the foundation 106 and located below one or more of the heel metatarsal and toe regions individually or in combination.

As discussed above, the size and shape of one or more resiliently compressible elements 110 can closely correspond to a shape of the recess 116 in the foundation 106 in some embodiments, such as that illustrated in FIGS. 4, 10 and 12 for example. In some embodiments, the resiliently compressible element 110 can have the same or substantially the same size and shape as the recess 116. In some embodiments, the resiliently compressible element 110 can be sized and shaped to engage all or substantially all of a peripheral wall 166 of the recess 116 when the sole 100 is uncompressed, the resiliently compressible element 110 is substantially uncompressed in a vertical direction, or both. In some embodiments, the resiliently compressible element 110 can be slightly compressed in a transverse direction by one or more peripheral walls 166 of the recess 116 when the sole 100 is uncompressed, the resiliently compressible element 110 is substantially uncompressed in a vertical direction, or both. In some embodiments the resiliently compressible element 110 can be compressed in a vertical direction with out any force being applied to the sole 100 by a foot. For example, in some embodiments, the uncompressed thickness of a resiliently compressible element 100 can be greater than a depth of a space in the sole into which the resiliently compressible element 100 is assembled. Pre-compression of one or more resiliently compressible elements can be used to provide a firmer "ride" for a user.

In some embodiments, the size and shape of the peripheral wall 166 of the resiliently compressible element 110 and the peripheral wall 118 of the recess 116 can be identical, whereas in other embodiments the peripheral wall 166 of the resiliently compressible element can be slightly larger or slightly smaller than the peripheral wall 118 of the recess 116. In preferred embodiments, the shape and size of the resiliently compressible element or elements 110 and the recess 116 or recesses 116 are close enough to inhibit, restrict, substantially prevent, or prevent transverse expansion of the resiliently compressible element or elements 110 when compressed in a generally vertical direction between a foot wearing the shoe and a support surface, such as the ground. This feature, where present, can reduce the onset of permanent deformation of the resiliently compressible element through use of the shoe. In some embodiments, this restriction of the transverse expansion of the resiliently compressible element or elements, where present, can increase the speed of rebound of the resiliently compressible element or elements from a compressed state.

In some embodiments, one or more resiliently compressible elements 110 can span an entire width of the sole 100 from the lateral side to the medial side. In some such embodiments, the peripheral wall 118 of the recess 116 can extend along the front and back sides of the one or more resiliently compressible elements to locate the one or more resiliently compressible elements beneath the foot and optionally control expansion of the one or more resiliently compressible elements in a direction between their front and back sides while a portion of the one or more resiliently compressible elements are exposed at the lateral and medial sides of the shoes. In some embodiments, the one or more resiliently compressible elements can be exposed at only one of the lateral and medial side of the shoe.

In some embodiments, the periphery 166 of one or more resiliently compressible elements can be configured to be stiffer than a portion of the one or more resiliently compressible elements that is within the periphery. For example, the periphery 166 of one or more resiliently compressible elements can be denser than a portion of the one or more resiliently compressible elements that is within the periphery. The periphery can be made denser, for example, though use of an injection molding operation wherein the periphery of the resilient compressible element is cooled more quickly than a portion of the resiliently compressible element within the periphery. In some embodiments, the periphery 166 of one or more resiliently compressible elements can be made stiffer by forming the one or more resiliently compressible elements with or otherwise attaching a different, stiffer material at the periphery 166. Stiffening the periphery 116 can provide advantages in some embodiments where one or more resiliently compressible elements are exposed through the foundation 106 to a side of the shoe and in some embodiments where one or more resiliently compressible elements are not so exposed.

In some embodiments, such as the embodiment of FIG. 4 for example, a resiliently compressible element 110 can comprise one or more protrusions 168, one or more recesses 170, or both around its perimeter. The protrusions 168 can correspond to the shape and location of metatarsal heads of a foot when the shoe is being worn. The recesses 170 can correspond to locations between metatarsal heads when the shoe is worn. In embodiments that include one or more protrusions 168, one or more recesses 170, or both, the protrusions 168 and recesses 170 can assist in preserving proper positioning of the resiliently compressible element 110 in the recess 116 beneath a foot. In embodiments that include one or more protrusions 168, one or more protrusions 170, or both, the protrusions 168 and recesses 170 can be positioned to be slightly outside a perimeter of one or more lugs 152 that underlie the resiliently compressible element 110.

In some embodiments, the resiliently compressible element or elements 110 can be configured to facilitate independent compression of different regions of the resiliently compressible element or elements 110. For example, a plurality of resiliently compressible elements 110 which are formed independently of each other can be used. In some embodiments, a single resiliently compressible element 110 can comprise one or more reliefs, such as holes, slots, slits, dimples, cups, craters, and grooves for example, to increase the independence of compression of adjacent areas of the resiliently compressible element 110. For example, as illustrated in FIG. 4, a resiliently compressible element 110 can comprise a plurality of holes 172 positioned in the resiliently compressible element.

The holes 172, or other reliefs, can be positioned so that they substantially or generally underlie a metatarsal bone of a foot when the shoe is worn (underlie completely or generally), as illustrated in FIG. 4 for example. As also illustrated in FIG. 4, the resiliently compressible element 110 can comprise a plurality of holes 172 arranged generally in a row beneath one or more of the metatarsal bones of a foot when the shoe is worn. In some embodiments, the holes 172 can be positioned at locations under and generally between adjacent metatarsal bones of a foot when the shoe is worn (not illustrated).

As illustrated in FIG. 19, the reliefs in the resiliently compressible element 110 can comprise a plurality of grooves 174 generally positioned between metatarsal bones of a foot when the shoe is worn and extending in a generally longitudinal direction (e.g. between heel and toes). The grooves 174 can be open to a lower surface 176 of a resiliently compressible element 110, as illustrated in FIG. 19 for example. In some embodiments, the resiliently compressible element 110 can include one or more grooves that are open to an upper surface 178 of a resiliently compressible element in addition to or in alternative to grooves that are open on a lower surface of the resiliently compressible element. In some embodiments, the one or more reliefs, such as the grooves 174 illustrated in FIG. 19 for example, if present, can extend substantially through or a majority of a distance through the resiliently compressible element 110 between the lower surface 176 and the upper surface 178. In some embodiments, the one or more reliefs, such as the holes 172 illustrated in FIG. 4 for example, can extend entirely through a resiliently compressible element 110 between the lower surface 176 and the upper surface 178. In some embodiments, holes, such as the holes 172, can extend only a portion of the way through the resiliently compressible element from one or both of the lower surface 176 and the upper surface 178.

In some embodiments, a thickness of the resiliently compressible element 110 between the lower surface 176 and the upper surface 178 can be substantially constant across a width (in a transverse direction generally between lateral and medial sides of the shoe) and a length (in a longitudinal direction generally between heel and toe regions of the shoe) of the resiliently compressible element. In some embodiments, as illustrated in FIG. 12 for example, one of the lower surface 176 and upper surface 178 of the resiliently compressible element can be non-planar. FIG. 12 illustrates upper surface 178 as being slightly concave. In embodiments where the shape of the lower surface 176 and the upper surface 178 differ from each other, the resiliently compressible element can have a thickness which varies across the length, the width, or both of the resiliently compressible element. As illustrated in FIG. 12 for example, the resiliently compressible element 110 can have a greater thickness at lateral and medial sides of the resiliently compressible element than in between them.

In some embodiments, such as the embodiment illustrated in FIGS. 3 and 12, the shoe can comprise one or more plates 112 positioned to be between the foot and the resiliently compressible element or elements 110 when the shoe is worn. When so positioned, the plates 112 may transmit pressure between the foot and the resiliently compressible element or elements 110. The plates 112 are preferably configured to distribute pressure applied by a foot against the sole 100 across an area on the resiliently compressible elements 110 that is larger than would otherwise occur if the plates were omitted. In some embodiments which employ one or more plates 112, an increase in the area over which applied pressure is distributed can significantly reduce the rate of onset of permanent deformation (e.g., crushing) of the resiliently compressible element or elements 110 through repeated compression and decompression. For example, Ethylene Vinyl Acetate (EVA) foam is used in the midsole of traditional running shoes to provide energy dissipation (cushioning). However, EVA foam has poor long term resilience, collapsing permanently under repeated load cycles such as by impact of a foot when running. This material degradation leads to an uneven surface under the foot, which increases rotational forces at the joints and unevenly applies forces on the bones and connective structures of the foot thereby increasing the likelihood of injury to a wearer of the shoe. Distributing pressure applied by the foot over an increased area can significantly reduce this breakdown of the material. Although EVA foam has been discussed as an example, onset of permanent deformation may be delayed in some embodiments including plates positioned between the foot and resiliently compressible elements of other materials. In some embodiments, one or more resiliently compressible elements 110 can be sandwiched between one or more plates 112 on one side and one or more lugs 152 on the other side. In some embodiments, one or more plates 112 can be positioned on one side of one or more resiliently compressible elements 110 without any lugs 152 being positioned on an opposing side. In some embodiments, one or more plates 112 can be positioned on opposing sides of a resiliently compressible element 110.

In some embodiments, positioning one or more plates 112 between the foot and the resiliently compressible element 110 can improve the ability of the nervous system to sense forefoot's interaction with the ground by reducing the damping effect of the materials of the sole which are positioned under foot. This reduced damping effect can give the wearer better afferent feedback (ability to feel and react to the ground) and improve the user's ability to self-regulate the intensity of force applied by the foot toward the ground at and following impact.

In some embodiments, distribution of the pressure applied by a foot to the resiliently compressible element or elements 110 across an increased area can reduce the time required for the resiliently compressible element 110 to rebound to its uncompressed state. In some embodiments the inclusion of one or more plate elements between the foot and the resiliently compressible element or elements can increase the size of the area over which pressure is applied to the resiliently compressible element or elements 110. In some embodiments, the incidence of local compression set can be reduced, delayed or both by positioning one or more plate elements between the foot and the resiliently compressible element or elements to increase the size of the area over which pressure is applied to the resiliently compressible element or elements 110.

The plate 112 can include one or more portions or segments 180 that are spaced from each other. For example, as illustrated in FIG. 3 for example, the plate 112 includes five plate segments 180 which are separated from each other by four spaces 182. The spaces 182 can comprise slots, as illustrated in FIG. 3, or can have other configurations. For example, the spaces 182 can comprise slits in some embodiments. Although FIG. 3 shows five plate segments 180, the plate 112 can comprise more or fewer than five plate segments 112 in some embodiments.

As illustrated in FIG. 3 for example, the plate segments 180 can be interconnected at their ends such that the plate segments 180 are cantilevered for articulated movement independent of each other. In some embodiments, the spaces 182 between plate segments 180 can extend a majority of a distance from a forward edge of the plate 112 to a rear edge of the plate. In some embodiments, the spaces 182 between plate segments 180 can extend approximately 20%, approximately 30%, approximately 40%, approximately 50%, approximately 60%, approximately 70%, approximately 80%, or approximately 90% of a distance from a forward edge of the plate 112 to a rear edge of the plate. In some embodiments, the spaces 182 do not extend to the forward edge of the plate 112. The spaces 182 preferably extend along the plate segments 180 by a distance sufficient to allow general, substantial or complete independence of movement of adjacent plate segments 180 under the influence of the metatarsal heads of a foot wearing the shoe. In some embodiments, a plate 112 need not have spaces which extend along plate segments by a distance sufficient to allow independent movement of adjacent plate segments under the influence of the metatarsal heads of a foot wearing the shoe.

Figure 20:
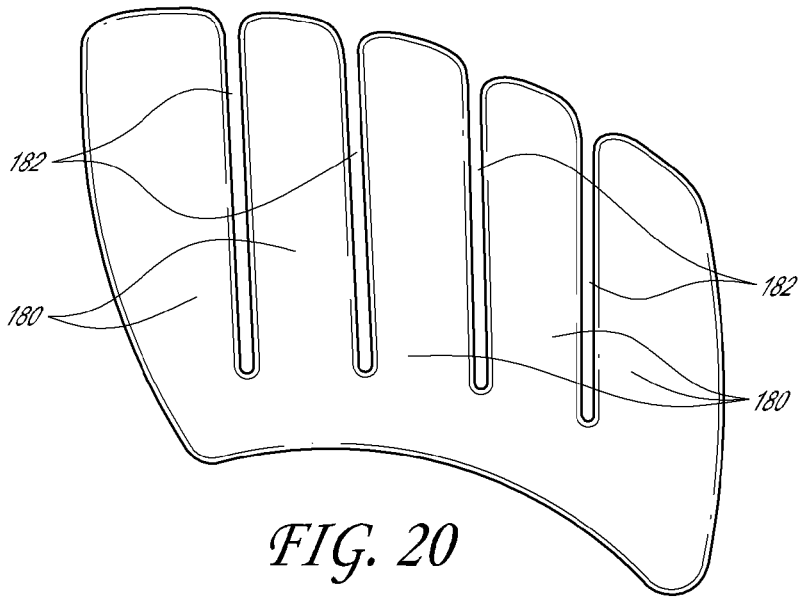
FIG. 20 is a top view of a plate according to an embodiment.

As illustrated in FIG. 3, the plate segments 180 can be sized and shaped to lie within the perimeter of the resiliently compressible element or elements 110 in some embodiments. In some embodiments, a plate element can be similar in shape to a corresponding resiliently compressible element 110. FIG. 20 illustrates an embodiment of a plate 112 with plate segments 180 that are sized and shaped to extend over resiliently compressible element or elements 110 and beyond a perimeter of the resiliently compressible element or elements 110. In some embodiments, a portion of a plate element, such as the plate 112 or plate elements 180, can be attached to a top surface of the foundation. In some embodiments, a plate element can be attached to a top surface of the foundation at a location rearward of the recess 116, a location forward of the recess 116, a location to a lateral side of the recess 116, a location to a medial side of the recess 116, or a combination thereof.

Plate elements, whether individual plates 112, plate segments 180, or a combination thereof, can be positioned so as to be below the metatarsal bones, such under as the metatarsal heads, of a foot when the shoe is worn. Although the plate 112 is illustrated as being positioned under a metatarsal region of the sole 100 in FIG. 3, one or more plate elements can be positioned under a heel region, a toe region, or a combination thereof in addition to or alternative to the metatarsal region.

The plate elements can be positioned to overlie individual regions of a single resiliently compressible element 110, particularly where the resiliently compressible element is segmented as discussed above, or over individual resiliently compressible elements. In some embodiments, the plate elements are positioned generally opposite lugs 152 across the resiliently compressible element or elements 110, as illustrated in FIG. 12 for example. The plate elements and lugs 152 can generally vertically aligned, as illustrated in FIG. 12 for example, so a region of a resiliently compressible element is compressed between a plate element and a lug when the sole is compressed by a foot against the ground in use. A plate element 180 can be substantially vertically aligned with a lug 152 as shown by centrally located plate elements 180 and lugs 152 in FIG. 12. A plate element 180 can be generally vertically aligned with, although horizontally offset from, a lug 152 as shown by the laterally and medially located plate elements 180 and lugs 152 in FIG. 12.

The plates 112 can be formed of plastic, composite, or other materials that are sufficiently rigid to distribute the applied pressure over an area of increased size. In some embodiments, the plates can be sufficiently flexible to undergo some elastic deformation under the loads applied by a foot. In some embodiments, the plates 112 can be formed of one or more materials, including thermoplastics, including DuPont Hytrel® and TPU, carbon fiber, glass fiber, boron fiber, fiber board, elastic rubber, and silicone rubber for example.

In some embodiments, one or more plates 112 can be adhered to one or more resiliently compressible elements 110, a portion of the foundation 106, an insole or sock liner that covers the recess 116 in the foundation 6, or a combination thereof. When one or more plates 112 are attached to the insole or sock liner, but adhered to neither the foundation 106 nor one or more resiliently compressible elements 110, the sole 110 can facilitate customization by a user, such as by exchange of plate elements or by exchange of resiliently compressible elements 110 as described above. For example, in some embodiments, a shoe sole can have at least one resiliently compressible element 110 removably received in the recess 116 in the foundation 106 such that, between uses of the shoe, a user can remove one resiliently compressible element without the aide of tools and without damaging the foundation 106 and then replace it with another resiliently compressible element that is substantially the same as the first or different from the first. This process can be facilitated where the one or more resiliently compressible elements are positioned in a recess 116 in the foundation 106 that opens toward an interior of the shoe. Where one or more plate elements are attached to an insole or sock liner, the elements can be removed with the insole to provide access for exchange resiliently compressible elements. Thereafter, the same or a different insole along with the one or more plate elements can be replaced by inserting them into the shoe so that the plate elements are appropriately positioned relative to the one or more resiliently compressible elements. In such embodiments, the useable life of the shoe may be prolonged by replacing a permanently deformed resiliently compressible element with a new one, the user can adapt the shoe sole to varying use conditions (e.g. the use environment and the user's attributes), or a combination thereof.

Figure 21:
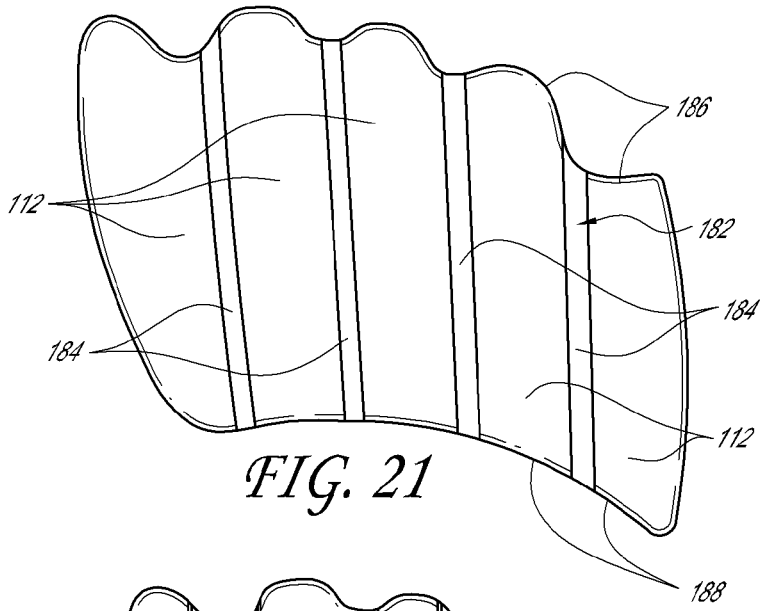
FIG. 21 is a top view of a plate according to an embodiment.

In some embodiments, a plurality of plate elements, such as plates 112 or plate segments 180, can be elastically interconnected. For example, as illustrated in FIG. 21, a plurality of plates 112 are connected by elastic portions 184 which span the spaces 182 between adjacent plates 112. As illustrated in FIG. 21, the elastic portions 184 can extend entirely or substantially entirely between forward edges 186 and rearward edges 188 of the plates 112 to elastically connect the plates 112. In some embodiments in which the elastic portions 184 connect a plurality of plates, the elastic portions 184 can extend less than substantially entirely between forward edges 186 and rearward edges 188 of the plates 112. In some embodiments, elastic portions, similar to the elastic portions 184 for example, can extend between adjacent plate segments 180 of a single plate 112 to elastically interconnect the plate segments 180.

The elastic portions 184 can be formed integrally with the plate elements in some embodiments. For example, the elastic portions 184 can, in some embodiments, be formed of the same material as the plate elements, but of a reduced thickness compared to the plate elements. In some embodiments, the elastic portions 184 can be formed integrally with the plate elements, but of a different material than the plate elements. In some embodiments, the plate elements can be formed before the elastic portions 184, and afterwards the elastic portions can be attached to the plate elements either during formation of the elastic portions or subsequent to their formation. In some embodiments, a plurality of plate elements can be elastically interconnected by a separately formed elastic membrane which spans both at least one space 182 and at least portions, if not all, of a plurality of plate elements. For example, a plate 112 such as that illustrated in FIG. 20, which includes a plurality of plate segments 180 and spaces 182 can be attached to an elastic membrane of a shape which is similar to the plate 112 but lacks the spaces 182 such that portions of the elastic membrane span the spaces 182.

Figure 23:
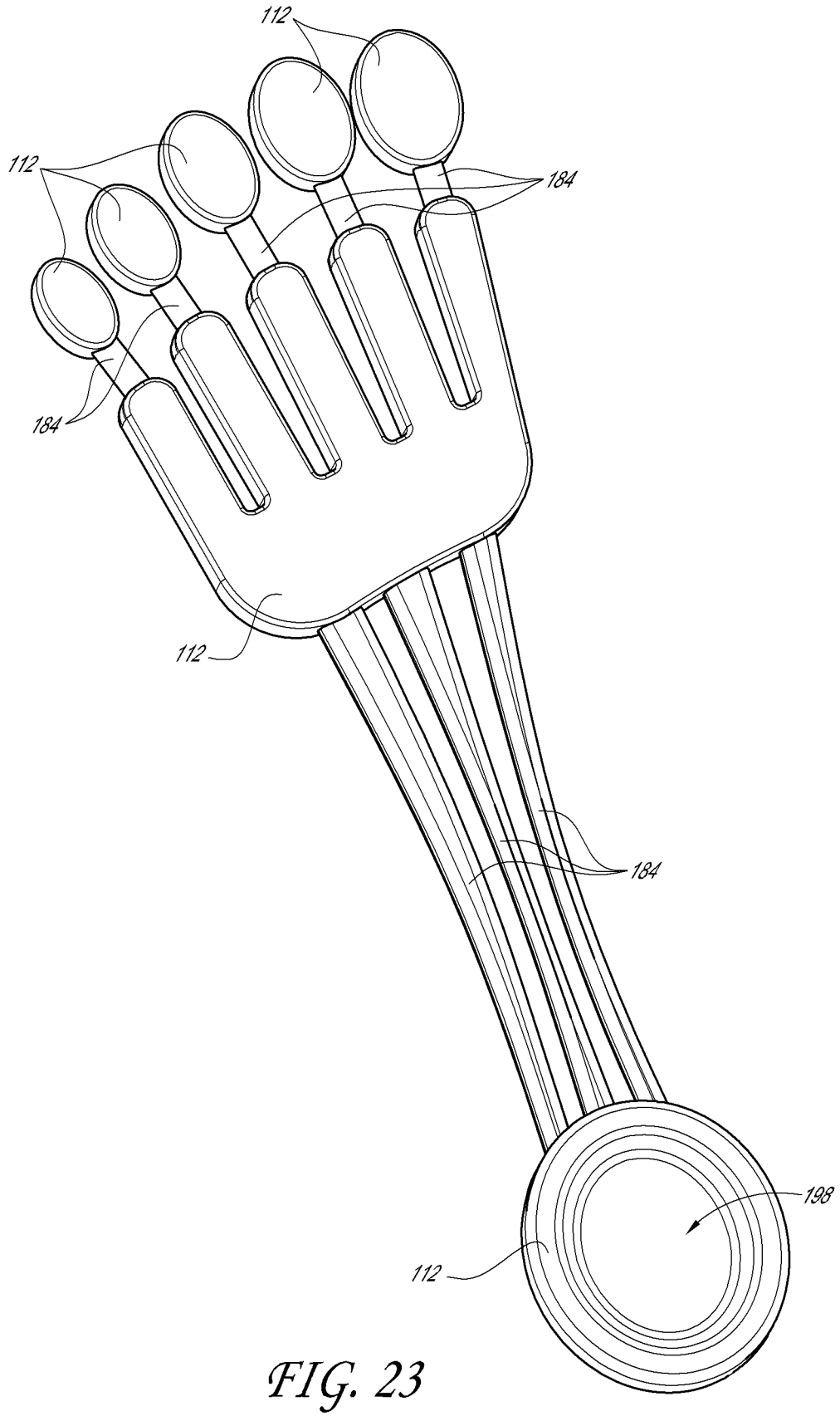
FIG. 23 is a perspective view of a plurality of elastically-interconnected plate elements according to an embodiment.

In soles 100 that include plate elements underlying a combination of regions of a foot selected from a group including heel, metatarsal, and toe regions, the plate elements underlying the same region can be elastically interconnected independently of or together with plate elements underlying another region of the foot. For example, in some embodiments, a plate underlying the heel can be elastically attached to one or more plate elements that underlie one or more metatarsal bones. In some embodiments, a plate underlying the heel can be elastically attached to one or more plate elements that underlie one or more toe bones. In some embodiments, one or more plate elements underlying the metatarsal region can be elastically interconnected with each one or more plate elements underlying the toe region. In some embodiments, a plurality of plate elements underlying the metatarsal region can be elastically interconnected with each other, and a plurality of plate elements underlying the toe region can be elastically interconnected with each other and the plate segments underlying the metatarsal region. In some embodiments, for example as illustrated in FIG. 23, a plate element 112 underlying the heel can be attached to one or more plate elements 112 that underlie one or more metatarsal bones, and one or more plate elements 112 that underlie one or more toe bones by elastic portions 184.

Figure 24:
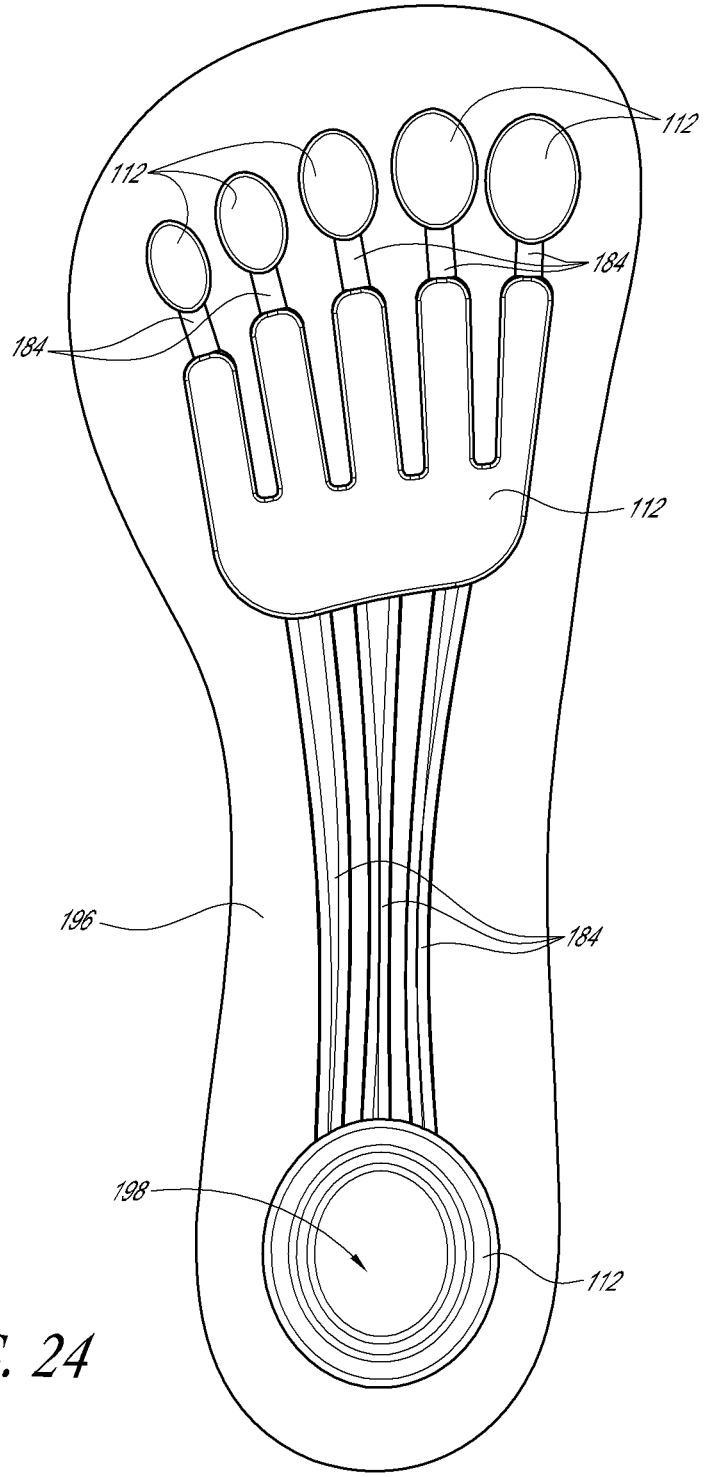
FIG. 24 is a plan view of the plurality of elastically-interconnected plate elements of FIG. 23 and a support.

As illustrated in FIG. 24, for example, a plurality of elastically-interconnected plate elements underlying a combination of regions of a foot can be attached to a support 198. The support 198 can be an insole or a midsole. For example, in some embodiments in which soles 100 include plate elements underlying a combination of regions of a foot selected from a group including heel, metatarsal, and toe regions, and in which plate elements are interconnected by a series of elastic portions or tendon-like elastic strips, the plate elements can be adhered or otherwise attached to an insole or sock liner, which spans some or all of the foot from heel to toes. In some embodiments in which soles 100 include plate elements underlying a combination of regions of a foot selected from a group including heel, metatarsal, and toe regions, and in which plate elements are interconnected by a series of elastic portions or tendon-like elastic strips 184, the plate elements can be contained at least partially or entirely within, adhered to, or otherwise attached to a foundation or midsole.

In use, a shoe sole comes into contact with a support surface, such as the ground, is compressed between the foot and the support surface, and is lifted from the ground with the foot. As the sole 100 is compressed between the foot and the support surface a number of actions can occur depending on the features included in the particular embodiment. Thus, the following description can relate to a number of different embodiments comprising different combinations of features. Also, although the following description refers to operation of portions of a shoe sole underlying a metatarsal region, other portions of the sole can operate similarly in connection with corresponding portions of a foot when the referenced features are included in those portions of the sole.

The resiliently compressible element or elements 110 are compressed as the sole 100 is compressed between the foot and the support surface. The compressed resiliently compressible element or elements 110 can urge the foot upward. In some embodiments, the resiliently compressible element or elements 110 can urge the foot upward during their expansion. In embodiments wherein the foundation 106 inhibits, restricts, or prevents lateral expansion of the resiliently compressible element or elements 110, such as by the above-described peripheral wall 118 of the recess 116 (see FIGS. 3, 10 and 12), the speed of rebound of the resiliently compressible element or elements 110 can be increased.

When, as illustrated in FIG. 12 for example, one or more plate elements (plates 112 or plate segments 180) are positioned between the metatarsal heads and the resiliently compressible element or elements 110, the plate elements can transfer generally vertically directed forces between the foot and the one or more resiliently compressible elements 110. As noted above, in some embodiments, the force applied to the resiliently compressible element or elements 110 by the one or more plate elements can be distributed over a larger area than if the plate elements were absent. A restorative force of the resiliently compressible element or elements 110 can be transferred by the plates to the foot urging the foot upward in some embodiments. In embodiments wherein the sole 100 comprises a plate 112 with cantilevered plate segments 180, the plate 112 can have a restorative force which urges the plate segments 180 toward an unstressed position. The restorative force of the plate 112 can urge the foot upward in some embodiments.

As the sole 100 is compressed between the foot and the support surface, the metatarsal heads of the foot may move downwardly at different rates and with different pressures being applied to different parts of the sole at different times. In embodiments wherein the sole 100 comprises a plurality of plate elements, such as in the embodiment illustrated in FIG. 12 for example, the plate elements (e.g., plate segments 180) can move generally independently of each other under the influence of corresponding metatarsal heads. In embodiments wherein elastic portions 184 connect the plate elements, movement of the plate elements relative to each other can stretch the elastic portions. Contraction of the elastic portions 184 can urge the foot upward in some embodiments.

In embodiments wherein the sole 100 comprises lugs 152 positioned below the one or more resiliently compressible elements 110, the resiliently compressible element or elements 110 and the lugs 152 are pressed together between the foot and the support surface. The lugs 152 may move toward the resiliently compressible element or elements 110 at different rates and with different applied pressures at different times depending, at least in part, on the composition and topography of the support surface. Thus, different portions of one or more resiliently compressible elements 110 may be compressed to different extents, at different rates, and at different times than adjacent portions. In embodiments wherein a sole 100 comprises a plurality of lugs 152 which are interconnected by elastic portions 114, movement of the lugs relative to each other can stretch the elastic portions. Contraction of the elastic portions 114 can urge the foot upward in some embodiments.

In some embodiments wherein the sole 100 comprises a plurality of lugs 152, the lugs can interact with the resiliently compressible element or elements 110 in a levering manner during forward motion of a wearer as the foot as reacts with the ground. For example, as the foot hinges or levers forward during the lift off phase of gait, the lugs 152 can be urged downwardly by the resiliently compressible element and, if present, the elastic membranes 154.

In embodiments wherein a portion of the foundation 106 is positioned between one or more resiliently compressible elements 110 and the lugs 152, the foundation 106 can be compressed as the sole 100 is compressed between the foot and the support surface. In some embodiments, wherein a portion 190 (see FIG. 12) of the foundation 106 is positioned between one or more resiliently compressible elements 110 and the outsole 108 (e.g., the lugs 152), that portion 190 can comprise a plurality of separations 192, such as slits for example, extending generally in a longitudinal direction (e.g. generally between the heel and toes regions of the shoe) and generally located between the metatarsal heads of the foot, the lugs 152 (if present), the plate elements (if present), or a combination thereof, as illustrated for example in FIGS. 5 and 12. The separations 192 can reduce coupling of movement, compression, and expansion of regions of the resiliently compressible elements 110 which are located on opposing sides of the separations.

Various embodiments are described above wherein the foundation 106, outsole 108, resiliently compressible element or elements 110, and plate elements 112, 180 are separated, segmented, or articulated, for example to facilitate relative movement, increase independence of movement, or both of various portions of those elements. Some exemplifying embodiments are described with reference to the 5 metatarsal heads of the forefoot. Such configurations can improve the ability of the metatarsal heads of a shod foot to move independently as they would in an unshod (bare) foot.

Although certain aspects of exemplifying sole embodiments have been described with reference to metatarsal bones of a foot, the features described herein can be used in connection with other parts of the foot, such as the heel, the toes, or both in addition to or alternative to the metatarsal bones of the foot.

For example, a sole 100 can comprise a foundation 106 with a recess 116 located to position one or more resiliently compressible elements 110 to underlie the heel of a foot when the shoe is worn. The foundation 106 can be configured to control transverse expansion of the one or more resiliently compressible elements 110 when the one or more resiliently compressible elements 110 are compressed. One or more outsole portions 108, possibly including lugs 152, elastic portions 154, or both can underlie the heel and the one or more resiliently compressible elements 110. One or more plate elements, e.g. plates 112 or plate segments 180, can be positioned between the heel and the one or more resiliently compressible elements 110. The plate elements can be elastically interconnected, for example by elastic portions 184.

As another example, a sole 100 can comprise, a foundation 106 with a recess 116 located to position one or more resiliently compressible elements 110 to underlie the toes of a foot when the shoe is worn. The foundation 106 can be configured to control transverse expansion of the one or more resiliently compressible elements 110 when the one or more resiliently compressible elements 110 are compressed. One or more outsole portions 108, possibly including lugs 152, elastic portions 154, or both can underlie the toes and the one or more resiliently compressible elements 110. One or more plate elements, e.g. plates 112 or plate segments 180, can be positioned between the toes and the one or more resiliently compressible elements 110. The plate elements can be elastically interconnected, for example by elastic portions 184.

Although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of the invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of at least some of the embodiments of the present invention herein described should not be limited by the particular disclosed embodiments described above.

What is claimed is:

1. A shoe sole, comprising:

at least one resiliently compressible element;

a foundation comprising a recess in an upper surface of the foundation configured to receive and locate the at least one resiliently compressible element within the recess below a region of a foot during both a relaxed condition and a compressed condition of the shoe sole;

a plurality of plate elements located on a top surface of and in direct contact with the at least one resiliently compressible element during both the relaxed condition and the compressed condition of the shoe sole; and a plurality of ground-engaging lugs located beneath and in direct contact with the foundation, the ground-engaging lugs generally aligned with the plate elements in a direction of compression such that at least a portion of the at least one resiliently compressible element is compressed between a plate element, and a generally aligned ground-engaging lug when the shoe sole is in the compressed condition.

2. The shoe sole of claim 1, wherein the foundation and the at least one resiliently compressible element are sized and shaped to closely correspond to each other.

3. The shoe sole of claim 1, wherein the plurality of plate elements are configured to transfer pressure individually between the foot and the resiliently compressible element.

4. The shoe sole of claim 1, wherein the ground-engaging lugs are elastically interconnected.

5. The shoe sole of claim 4, wherein the ground-engaging lugs are elastically interconnected by an elastic membrane formed independently of the ground-engaging lugs.

6. The shoe sole of claim 1, wherein the plate elements are elastically interconnected.

7. The shoe sole of claim 1, wherein the at least one resiliently compressible element is removably received in the foundation such that the at least one resiliently compressible element can be removed and replaced with another resiliently compressible element without the use of a tool.

8. The shoe sole of claim 1, further comprising an insole, the plurality of plate elements attached to the insole so that the plate elements can be removed with the insole.

9. The shoe sole of claim 1, wherein the foundation locates the resiliently compressible element such that the resiliently compressible element underlies metatarsal heads of the foot during use.

10. The shoe sole of claim 1, wherein the resiliently compressible element is sized and shaped to at least partially underlie five metatarsal heads of the foot during use.

11. The shoe sole of claim 1, wherein the plurality of plate elements are formed as a plurality of segments of a single plate.

12. The shoe sole of claim 1, wherein the plurality of plate elements are sized, shaped, and located such that each of the plate elements at least partially underlies a metatarsal head of the foot during use.

13. The shoe sole of claim 10, wherein the plurality of plate elements comprises five plate elements.

14. A shoe sole, comprising:

at least one resiliently compressible element;

a foundation comprising a recess in an upper surface of the foundation configured to receive and locate the at least one resiliently compressible element within the recess below a region of a foot during both a relaxed condition and a compressed condition of the shoe sole; and a plurality of plate elements located on a top surface of and in direct contact with the at least one resiliently compressible element during both the relaxed condition and the compressed condition of the shoe sole, the plurality of plate elements configured to transfer pressure individually between the foot and the resiliently compressible element; and a plurality of ground-engaging lugs located beneath and in direct contact with the foundation and located on an opposite side of the resiliently compressible element.

15. The shoe sole of claim 14, wherein the foundation and the at least one resiliently compressible element are shaped such that expansion of the at least one resiliently compressible element is inhibited in a direction transverse to a direction of compression of the shoe sole when the shoe sole is compressed by the foot during use.

16. The shoe sole of claim 14, further comprising the lugs generally aligned with the plate elements in a direction of compression such that at least a portion of the at least one resiliently compressible element is compressed between a plate element and a generally aligned lug as the shoe sole is compressed against a support surface by the foot during use.

17. The shoe sole of claim 16, wherein the lugs are elastically interconnected.

18. The shoe sole of claim 17, wherein the lugs are elastically interconnected by an elastic membrane formed independently of the lugs.

19. The shoe sole of claim 14, wherein the plate elements are elastically interconnected.

20. The shoe sole of claim 16, wherein the lugs are generally aligned with the plate elements in a direction of compression such that at least a portion of the at least one resiliently compressible element is compressed between a plate element and a generally aligned lug as the shoe sole is compressed against the support surface by the foot during use.

21. The shoe sole of claim 14, wherein the at least one resiliently compressible element is removably received in the foundation such that the at least one resiliently compressible element can be removed and replaced with another resiliently compressible element.

22. The shoe sole of claim 14, further comprising an insole, the plurality of plate elements attached to the insole so that the plurality of plate elements can be removed with the insole.

23. A shoe, comprising:

an upper configured to receive a foot; and a sole attached below the upper, the sole comprising:

at least one resiliently compressible element;

a foundation layer defining a longitudinal axis extending from a heel portion to a toe portion of the foundation layer, the foundation layer having an upper surface facing the upper and a lower surface, the foundation layer defining a recess in the upper surface in a forefoot region of the foundation layer configured to receive and locate the at least one resiliently compressible element within the recess during both a relaxed condition and compressed condition of the shoe sole;

a plurality of plate elements located on a top surface of and in direct contact with the at least one resiliently compressible element during both the relaxed condition and the compressed condition of the shoe sole, the plate elements having a plurality of longitudinal slots each extending from a toe end of the plate elements partially toward a heel end of the plate elements to partially divide the plate into articulating portions; and a plurality of lugs configured to contact ground and located beneath and in direct contact with the lower surface of the foundation layer, the lugs generally aligned with the articulating portions of the plate elements.

24. The shoe of claim 23, wherein the foundation layer comprises ethylene-vinyl acetate.

25. The shoe of claim 23, wherein the resiliently compressible element comprises polyurethane foam.

26. The shoe of claim 23, wherein the resiliently compressible element comprises a plurality of holes extending through the resiliently compressible element between the upper surface and the lower surface, wherein the holes are arranged in a plurality of rows extending generally along the longitudinal axis, wherein there are five rows of holes configured to underlie metatarsal heads of the foot when the shoe is worn.

27. The shoe of claim 23, wherein the plate elements are made of thermoplastic and have a shape that generally corresponds with a shape of the recess and a shape of the resiliently compressible element.

28. The shoe of claim 23, wherein the plate elements comprises four slots to partially divide the plate elements into five articulating portions that are configured to underlie metatarsal heads of the foot.

29. The shoe sole of claim 1, further comprising an elastic membrane positioned between the foundation in between and the at least one resiliently compressible element.

30. The shoe sole of claim 1, further comprising an open area between two of the plurality of ground-engaging lugs generally aligned with a groove of the resiliently compressible element.

31. The shoe sole of claim 1, wherein the at least one resiliently compressible element includes at least one groove.

32. The shoe sole of claim 31, wherein the plurality of plate elements are spaced, and wherein each space between the spaced plate elements is aligned to a corresponding groove in the at least one resiliently compressible element.

* * * * *